US011674262B2

(12) United States Patent
Kelly

(10) Patent No.: US 11,674,262 B2
(45) Date of Patent: Jun. 13, 2023

(54) SUPERCRITICAL FLUID ROLLED OR SPOOLED MATERIAL FINISHING

(71) Applicant: NIKE, Inc., Beaverton, OR (US)

(72) Inventor: Matt W. Kelly, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 87 days.

(21) Appl. No.: 16/983,272

(22) Filed: Aug. 3, 2020

(65) Prior Publication Data

US 2020/0362510 A1 Nov. 19, 2020

Related U.S. Application Data

(62) Division of application No. 15/048,639, filed on Feb. 19, 2016, now Pat. No. 10,731,291.

(60) Provisional application No. 62/296,987, filed on Feb. 18, 2016, provisional application No. 62/119,015, filed on Feb. 20, 2015, provisional application No. 62/119,010, filed on Feb. 20, 2015.

(51) Int. Cl.

| | |
|---|---|
| ***D06P 5/20*** | (2006.01) |
| ***D06M 23/10*** | (2006.01) |
| ***D06P 1/94*** | (2006.01) |
| ***D06P 5/00*** | (2006.01) |
| ***D06B 19/00*** | (2006.01) |
| ***D06M 23/00*** | (2006.01) |
| ***D06B 5/16*** | (2006.01) |
| ***D06P 5/24*** | (2006.01) |

(52) U.S. Cl.

CPC ..... *D06P 5/2055* (2013.01); *D06B 5/16* (2013.01); *D06B 19/00* (2013.01); *D06M 23/00* (2013.01); *D06M 23/105* (2013.01); *D06P 1/94* (2013.01); *D06P 5/003* (2013.01)

(58) Field of Classification Search

CPC ..... D06P 5/2055; D06P 5/003; D06P 1/94; D06M 23/00; D06M 23/105; D06B 5/16; D06B 19/00

See application file for complete search history.

(56) References Cited

U.S. PATENT DOCUMENTS

| | | | | |
|---|---|---|---|---|
| 5,298,032 | A | 3/1994 | Schlenker et al. | |
| 5,340,614 | A | 8/1994 | Perman et al. | |
| 5,508,060 | A | 4/1996 | Perman et al. | |
| 5,798,438 | A | 8/1998 | Sawan et al. | |
| 5,938,794 | A | 8/1999 | Eggers et al. | |
| 5,958,085 | A | 9/1999 | Eggers et al. | |
| 6,048,369 | A | 4/2000 | Smith et al. | |
| 6,183,521 | B1 | 2/2001 | Lin et al. | |
| 6,261,326 | B1 | 7/2001 | Hendrix et al. | |
| 6,615,620 | B2 | 9/2003 | Hendrix et al. | |
| 7,938,865 | B2 | 5/2011 | Fernandez et al. | |
| 10,480,123 | B2 | 11/2019 | Kelly et al. | |
| 2001/0020311 | A1 | 9/2001 | Veugelers et al. | |
| 2002/0108183 | A1* | 8/2002 | Smith | D06P 1/94 8/116.1 |
| 2002/0119721 | A1 | 8/2002 | Panandiker et al. | |
| 2007/0264175 | A1 | 11/2007 | Iversen et al. | |
| 2011/0138547 | A1 | 6/2011 | Fernandez et al. | |
| 2012/0030884 | A1* | 2/2012 | Carlson | D06P 1/38 8/618 |
| 2012/0047665 | A1 | 3/2012 | Yager | |
| 2014/0305170 | A1 | 10/2014 | Fetner et al. | |
| 2016/0244909 | A1 | 8/2016 | Kelly et al. | |
| 2016/0244912 | A1 | 8/2016 | Kelly | |

FOREIGN PATENT DOCUMENTS

| | | | | |
|---|---|---|---|---|
| CN | 1693580 | A | 11/2005 | |
| CN | 101812809 | A | 8/2010 | |
| CN | 101812810 | A | 8/2010 | |
| CN | 102877329 | A | 1/2013 | |
| CN | 102787459 | B | 1/2014 | |
| CN | 102776739 | B | 4/2014 | |
| CN | 103726351 | A | 4/2014 | |
| CN | 103741523 | A | 4/2014 | |
| CN | 203546404 | U | 4/2014 | |
| CN | 104342869 | A | 2/2015 | |
| DE | 3906724 | A1 | 9/1990 | |
| DE | 4333221 | * | 4/1995 | B01D 11/02 |
| DE | 4333221 | A1 | 4/1995 | |
| JP | 2002-4169 | A | 1/2002 | |
| JP | 2004-76190 | A | 3/2004 | |
| JP | 2005273098 | A | 10/2005 | |
| JP | 2009-178501 | A | 8/2009 | |
| WO | 93/14255 | A1 | 7/1993 | |
| WO | 94/18264 | A1 | 8/1994 | |

(Continued)

OTHER PUBLICATIONS

Final Office Action received for U.S. Appl. No. 16/661,688, dated Nov. 9, 2021, 6 pages.

Notice of Allowance received for U.S. Appl. No. 16/661,688, dated Mar. 3, 2022, 7 pages.

Final Office Action received for U.S. Appl. No. 16/661,688, dated Nov. 12, 2020, 9 pages.

Hansheng Zhao et al., "History of Mass Textile Technology", Supercritical carbon dioxide fluid dyeing, Jinan: Shandong Science and Technology Press Co. Ltd., Jun. 30, 2015, pp. 227-228 (Official copy only) (See attached communication 37 CFR § 1.98(a) (3)).

Jiangjian Liu, "New Dyeing and Finishing Energy-Saving and Emission-Reduction Technology", Supercritical CO2 fluid dyeing, Beijing: China Textile & Apparel Press, May 31, 2015, pp. 133-138 (Official copy only) (See attached communication 37 CFR § 1.98(a) (3)).

(Continued)

*Primary Examiner* — Amina S Khan

(74) *Attorney, Agent, or Firm* — Shook, Hardy & Bacon L.L.P.

(57) ABSTRACT

Methods are directed to the use of a supercritical fluid for performing a dyeing of a material such that dye from a first material is used to dye a second material. A supercritical fluid is passed through a first material in a pressurized vessel. The supercritical fluid transports the dye from the first material to at least a second material causing a dye profile of the second material to change as a result of dye from the first material perfusing the second material.

12 Claims, 11 Drawing Sheets

(56) References Cited

FOREIGN PATENT DOCUMENTS

| | | | | |
|---|---|---|---|---|
| WO | 99/63146 A1 | | 12/1999 | |
| WO | WO99/63146 | * | 12/1999 | ..... D06P 5/00 |
| WO | 02/33163 A1 | | 4/2002 | |

OTHER PUBLICATIONS

Extended European Search Report received for European Patent Application No. 20200565.8, dated Feb. 2, 2021, 7 pages.
Non-Final Office Action received for U.S. Appl. No. 16/661,688, dated Mar. 15, 2021, 9 pages.
Montero et al., "Supercritical Fluid Technology in Textile Processing: An Overview", Industrial & Engineering Chemistry Research, vol. 39, No. 12, 2000, pp. 4806-4812.
Stryjek et al., "PRSV: An Improved Peng-Robinson Equation of State for Pure Compounds and Mixtures", The Canadian Journal of Chemical Engineering, vol. 64, Apr. 1986, pp. 323-333.
Office Action received for European Patent Application No. 20200565.8 dated Mar. 23, 2023, 4 pages.

* cited by examiner

SUPERCRITICAL FLUID ROLLED OR SPOOLED MATERIAL FINISHING

CROSS-REFERENCE TO RELATED APPLICATIONS

This application is a divisional of U.S. Nonprovisional application Ser. No. 15/048,639, entitled Supercritical Fluid Rolled or Spooled Material Finishing, filed Feb. 19, 2016 (the "'639 Application") now U.S. Pat. No. 10,731,291. The '639 Application claims the benefit of U.S. Provisional Applications: 1) U.S. Provisional Patent Application 62/119,015, entitled Dyeing of Spooled Material with a Supercritical Fluid, filed on Feb. 20, 2015, 2) U.S. Provisional Patent Application 62/119,010 entitled Equilibrium Dyeing of Rolled Material with a Supercritical Fluid, filed on Feb. 20, 2015, and 3) U.S. Provisional Patent Application 62/296,987, entitled Supercritical Fluid Rolled or Spooled Material Finishing, filed on Feb. 18, 2016. The entireties of the aforementioned applications are incorporated by reference herein.

TECHNICAL FIELD

Processing, dyeing, and treating of materials, such as fabric and or a yarn, with a supercritical fluid.

BACKGROUND

Traditional dyeing of materials relies on a large quantity of water, which can be detrimental to the fresh water supply and also result in undesired chemicals entering into the wastewater stream. As a result, use of a supercritical fluid has been explored as an alternative to the traditional water dye processes. However, a number of challenges have been encountered with the use of a supercritical fluid ("SCF"), such as carbon dioxide ("$CO_2$"), in a dyeing process. For example, the interaction of dye materials with a SCF, including the solubility, introduction, dispersion, circulation, deposition, and characterization of the interaction, have all posed problems to industrial-scale implementation of dyeing with a SCF. U.S. Pat. No. 6,261,326 ("'326 patent") to Hendrix et. al, filed Jan. 13, 2000 and assigned to North Carolina State University attempts to address previously explored solutions to the SCF and dye material interactions. The '326 patent attempts to remedy the complications of the interaction with a separate preparation vessel for introducing the dye to a SCF and then transferring the solution of dye and SCF into a textile treatment system to dye a material. In the example of the '326 patent, the dye is introduced into the vessel containing the material to be dyed in conjunction with the SCF, which can increase the complexity of the process and componentry of the system.

BRIEF SUMMARY

Methods and systems are directed to the use of a supercritical fluid for performing a dyeing of a material such that a dye, which may be a colorant or other material finish, from a first material is used to dye a second material within a common vessel. A dye-free supercritical fluid is passed through a first material in a pressurized vessel. The supercritical fluid transports dye from the first material to at least a second material causing a dye profile of the second material to change as the dye perfuse the second material. The first material may be in contact or physically separate from the second material within the pressure vessel. Also, the dye of the first material is integral with the first material at the start of the dyeing process, in an exemplary aspect.

BRIEF DESCRIPTION OF THE DRAWINGS

The present invention is described in detail herein with reference to the attached drawing figures, wherein.

DETAILED DESCRIPTION

Methods are directed to the use of a supercritical fluid for performing a dyeing of a material such that dye, which may be a colorant or other material finish, from a first material is used to dye a second material within a common vessel. A supercritical fluid is passed through a first material in a pressurized vessel. The supercritical fluid transports dye from the first material to at least a second material causing a dye profile of the second material to change as the dye perfuse the second material. The first material may be in contact or physically separate from the second material within the pressure vessel. Also, the dye of the first material is integral with the first material at the start of the dyeing process in an exemplary aspect.

Methods are also directed to dyeing a material by positioning at least a first sacrificial material with a first dye profile and a target material with a second dye profile in a common pressure vessel such that the first sacrificial material is not in contact with the target material. The method continues with introducing carbon dioxide within the pressure vessel such that the carbon dioxide achieves a supercritical fluid state while in the pressure vessel. Supercritical fluid carbon dioxide is used to perfuse the target material with dye from the first sacrificial material dye profile, wherein the dye from the first sacrificial material is integral with the first sacrificial material prior to introducing the carbon dioxide. Additional aspects further contemplate positioning a second sacrificial material with a third dye profile in the pressure vessel prior to achieving the supercritical fluid state of the carbon dioxide and then perfusing the target material with dye from the second sacrificial material dye profile while perfusing the target material with dye from the first sacrificial material dye profile.

An additional exemplary method contemplated is directed dyeing a material by positioning at least a first sacrificial material with a first dye profile and a target material with a second dye profile in a common pressure vessel such that the first sacrificial material is in contact with the target material. The method includes introducing carbon dioxide within the pressure vessel such that the carbon dioxide achieves a supercritical fluid state while in the pressure vessel. Supercritical fluid carbon dioxide is used to perfuse the target material with dye from the first sacrificial material dye profile. Additional aspects contemplate positioning a second sacrificial material with a third dye profile in the pressure vessel prior to achieving the SCF state and perfusing the target material with dye from the second sacrificial material dye profile while perfusing the target material with dye from the first sacrificial material dye profile.

Figure 9:
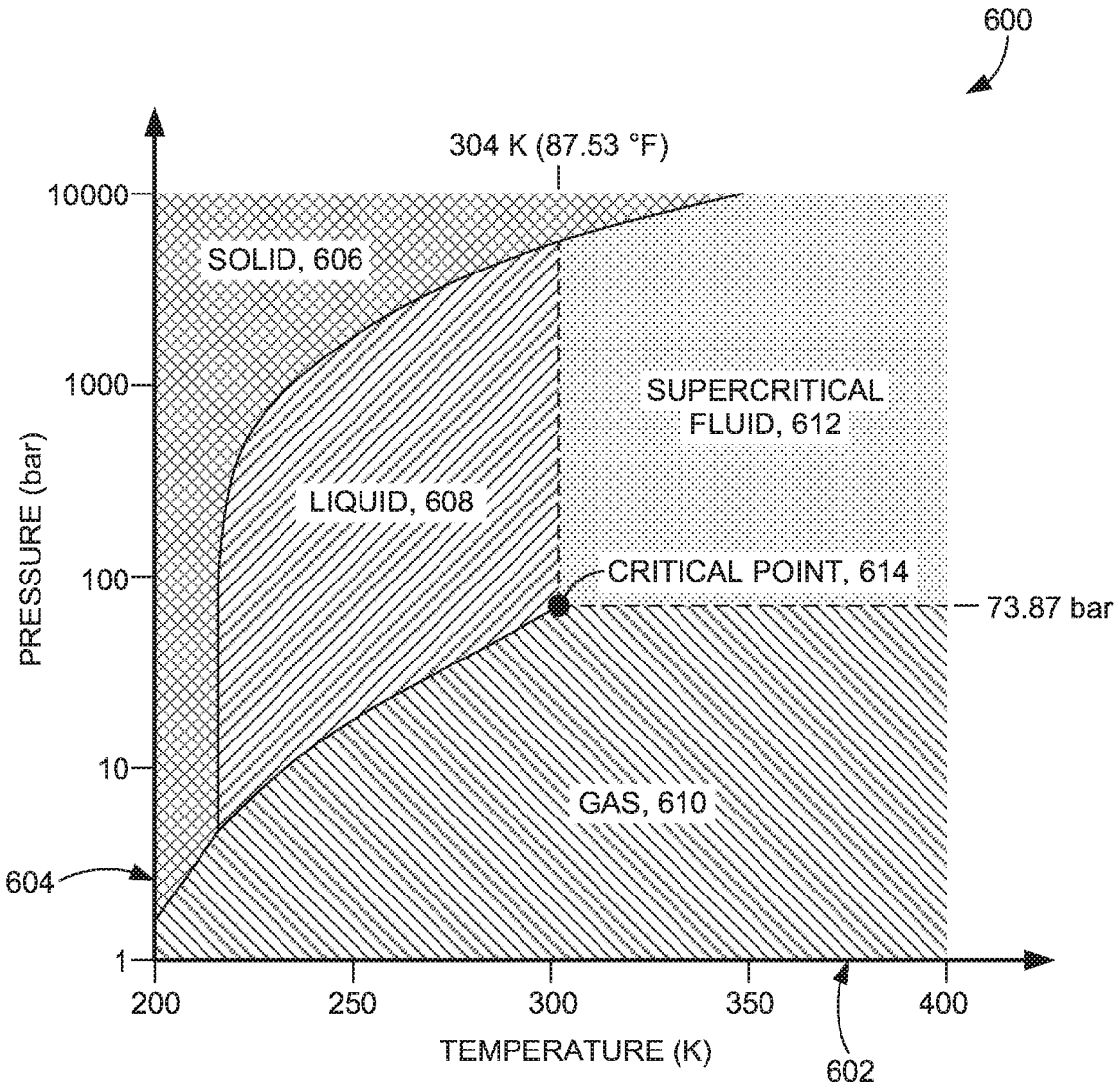
FIG. 9 depicts a temperature and pressure phase diagram for carbon dioxide, in accordance with an aspect hereof.

Supercritical fluid ("SCF") carbon dioxide ("$CO_2$") is a fluid state of $CO_2$ that exhibits characteristics of both a gas and a liquid. SCF $CO_2$ has liquid-like densities and gas-like low viscosities and diffusion properties. The liquid-like densities of SCF allows for SCF $CO_2$ to dissolve dye material and chemistries for eventual dyeing of a material. The gas-like viscosity and diffusion properties can allow for a faster dyeing time and faster dispersion of dye material than in a traditional water-based process, for example. FIG. 9 provides a $CO_2$ pressure 604 and temperature 602 diagram that highlights the various phases of $CO_2$, such as a solid phase 606, a liquid phase 608, a gas phase 610, and a SCF phase 612. As illustrated, $CO_2$ has a critical point 614 at about 304 degrees Kelvin (i.e. 87.53 degrees Fahrenheit, 30.85 Celsius) and 73.87 bar (i.e. 72.9 atm). Generally, at temperatures and pressures above the critical point 614, $CO_2$ is in a SCF phase.

While examples herein refer specifically to SCF $CO_2$, it is contemplated that additional or alternative compositions may be used at or near a supercritical fluid phase. Therefore, while specific reference will be made to $CO_2$ as a composition herein, it is contemplated that aspects hereof are applicable with alternative compositions and appropriate critical point values for achieving a SCF phase.

The use of SCF $CO_2$ in a dyeing process may be achieved using commercially available machines, such as a machine offered by DyeCoo Textile Systems BV of the Netherlands ("DyeCoo"). A process implemented in a traditional system includes placing an undyed material that is intended to be dyed into a vessel capable of being pressurized and heated to achieve a SCF $CO_2$. A powdered dyestuff that is not integrally associated with a textile (e.g., loose powder) is maintained in a holding container. The dyestuff holding container is placed in the vessel with the undyed material such that the dyestuff is not contacting the undyed material prior to pressurizing the vessel. For example, the holding container physically separates the dyestuff from the undyed material. The vessel is pressurized and thermal energy is applied to bring $CO_2$ to a SCF (or near SCF) state, which causes the dyestuff to solubilize in the SCF $CO_2$. In a traditional system, the dyestuff is transported from the holding container to the undyed material by the SCF $CO_2$. The dyestuff is then diffused through the undyed material causing a dyeing of the undyed material until the SCF $CO_2$ phase is ceased.

Aspects herein relate to a concept of dye equilibrium as a manner of controlling a dye profile that results on a material. For example, if a first material has a dye profile that may be described as a red coloration and a second material has a dye profile that may be described by an absence of coloration (e.g., bleached or white), the concept of equilibrium dyeing with SCF $CO_2$ results in an attempted equalization between the two dye profiles such that at least some of the dyestuff forming the first dye profile is transferred from the first material to the second material. An application of this process includes using a sacrificial material having dyestuff contained thereon and/or therein (e.g., a dyed first material) that is used as a carrier for applying a specific dyestuff to a second material that is intended to be dyed by the dyestuff of the sacrificial material. For example, a first material and a second material may each have different resulting dye profiles from each other after a SCF $CO_2$ process is applied while also having a different dye profile from their respective initial dye profiles (e.g., first dye profile and second dye profile). This lack of true equilibrium may be desired. For example, if the first material is the sacrificial material that is merely intended to be a dye carrier, the process may be carried out until the second material achieves a desired dye profile, regardless of the resulting dye profile for the first material, in an exemplary aspect.

Another example of a dyeing process using SCF $CO_2$ may be referred to as an additive dyeing process. An example to aid in illustrating the additive dyeing process includes the first material having a dye profile that exhibits red coloration and the second material having a second dye profile that exhibits blue coloration. The SCF $CO_2$ is effective to result in dye profiles on the first material and the second material (and/or a third material) that exhibit purple coloration (e.g., red+blue=purple).

As before, it is contemplated that the first and second materials may achieve a common dye profile when the equilibrium dye process is allowed to mature. In additional aspects, it is contemplated that the first material and the second material result in different dye profiles from each other, but the resulting dye profiles are also different from the initial dye profile for each respective material. Further, it is contemplated that the first material may be a sacrificial dye transfer material while the second material is the material for which a target dye profile is desired. Therefore, the SCF $CO_2$ dye process may be performed until the second material achieves the desired dye profile regardless of the resulting dye profile of the first material. Further yet, it is contemplated that a first sacrificial material dye carrier having a first dye profile (e.g., red) and a second sacrificial dye carrier having a second dye profile (e.g., blue) may be placed into the system to cause a desired dye profile (e.g., purple) on a third material, in an exemplary aspect. As can be appreciated, any combination and number of materials, dye profiles, and other contemplated variables (e.g., time, SCF $CO_2$ volume, temperature, pressure, material composition, and material type) may be altered to achieve results contemplated herein.

Aspects herein contemplate dyeing (e.g., treating with material finishes) of one or more materials using SCF $CO_2$.

The concept of two or more materials used in conjunction with each other is contemplated in aspects hereof. Further, the use of one or more materials having integral dyestuff that are not intended for traditional post-processing utilization (e.g., apparel manufacturing, shoe manufacturing, carpeting, upholstery), which may be referred to as sacrificial material or as dye carriers, are contemplated as being introduced in the system. Further, it is contemplated that any dye profile may be used. Any combination of dye profiles may be used in conjunction with one another to achieve any desired dye profile in one or more materials. Additional features and process variable for disclosed methods and systems will be provided herein.

Achieving a desired dye profile on a material may be influenced by a number of factors. For example, if there are 50 kg of a first material (e.g., spooled or rolled material) and 100 kg of a second material, the resulting dye profile per weight of the first material may be expressed as ⅓ the original color/intensity/saturation of the first dye profile when the second material original dye profile is absent of dye. Alternatively, with the same proportions of material but the original second dye profile having a comparable saturation/intensity as the first dye profile, but with a different coloration, the first dye profile may be expressed as ⅓X+⅓Y where X is the original first dye profile and Y is the original second dye profile (i.e. weight of the first material/weight of all materials). From the second material perspective using the two previous examples, the resulting dye profiles may be (⅔X)/2 for the first example and (⅔X+⅔Y)/2 (i.e. [weight of the first material/weight of all materials] *[weight of the first material/weight of the second material]). The previous examples are for illustration purposes only as it is contemplated that a number of additional factors are also relevant, such as yardage per kilogram, material composition, dye process length, temperature, pressure, time, material porosity, material density, winding tension of the material, and other variables that may be represented by an empirical value(s). However, the preceding is intended to provide an understanding of the intended equilibrium dyeing process to supplement the aspects provided herein. As such, the provided examples and values are not limiting but merely exemplary in nature.

Figure 1:
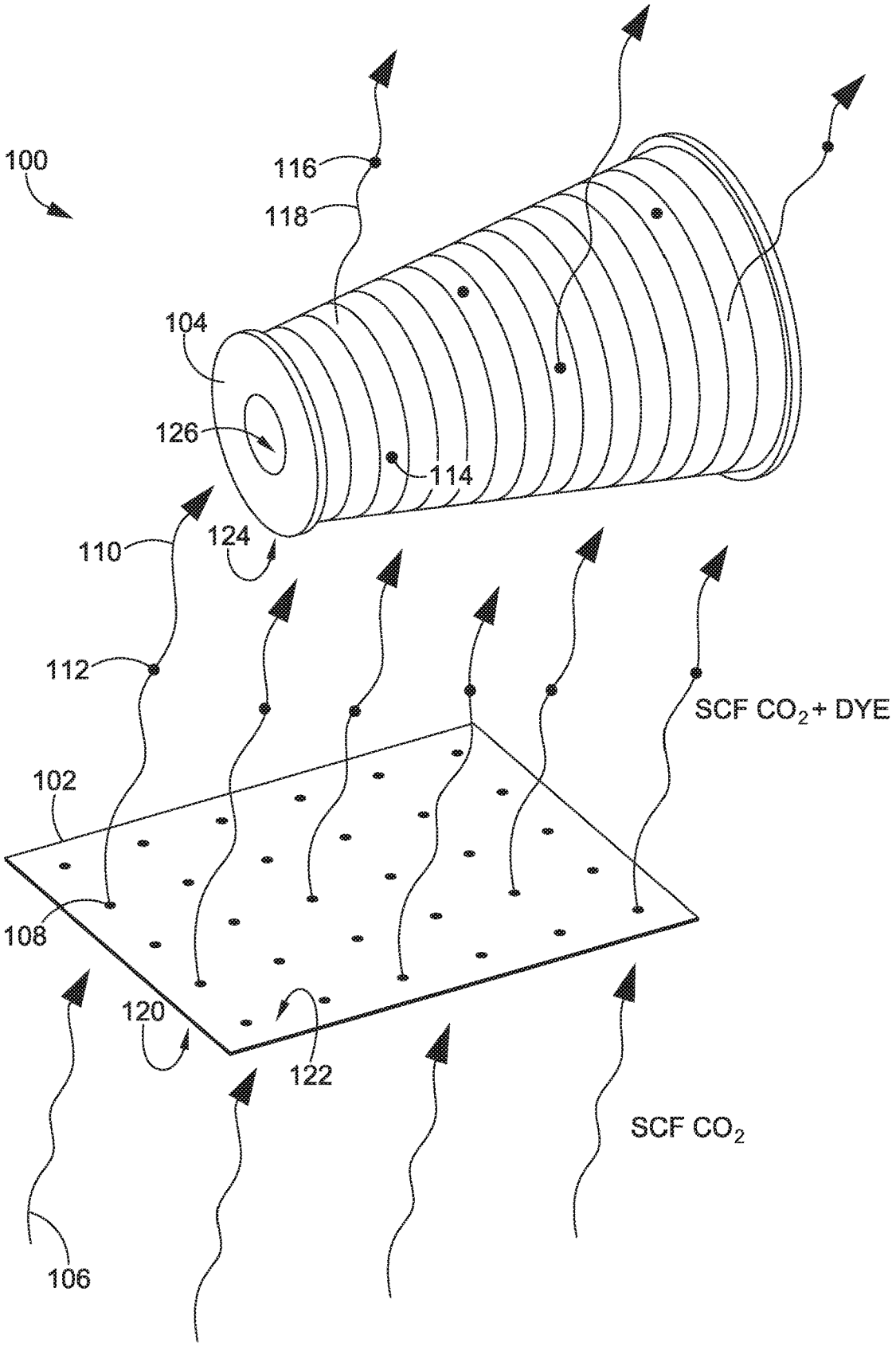
FIG. 1 is an exemplary illustration depicting the transfer of dye to a spooled material from a second material by way of a supercritical fluid, in accordance with an aspect hereof.

Referring now to FIG. 1, an exemplary illustration depicting the transfer of dye 100 from a second material 102 to a spooled material 104 by way of a SCF $CO_2$, in accordance with aspects hereof. A material introduced to the dyeing process with SCF $CO_2$ may be any material, such as compositions (e.g., cotton, wool, silk, polyester, and/or nylon), substrates (e.g., fabrics and/or yarns), products (e.g., footwear and/or garments), and the like. In an exemplary aspect, the second material 102 is a polyester material having a first dye profile comprised of dye material 108. A dye profile is a dye characteristic or material finish characteristic, which may be defined by a color, intensity, shade, dyestuff type(s), and/or chemical composition. It is contemplated that a material for which there is no substantial dyestuff (e.g., no unnaturally occurring coloration from a dyeing method or other material finishes applied thereon) also has a dye profile that describes the absence of dye. Therefore, regardless of the coloration, finish, or dye associated with a material, all materials have a dye profile. Stated differently, all materials, irrespective of color/material finish processes performed (or not performed), has a dye profile. For example, all materials have a starting coloration regardless of if a dye process has been performed on the material.

The second material 102 has a first surface 120, a second surface 122, and a plurality of dye material 108. The dye material 108, which may be a composition/mixture of dyestuffs, is depicted as granular elements for discussion purposes; however, in actuality the dye material 108 may not be individually identifiable at the macro level from the underlying substrate of a material. Also, as will be discussed hereinafter, it is contemplated that the dyestuff may be integral with the material. Integral dyestuff is dyestuff that is chemically or physically bonded with the material. Integral dyestuff is compared to non-integral dyestuff, which is dyestuff that is not chemically or physically coupled with a material. An example of a non-integral dyestuff includes dry powdered dyestuff sprinkled and brushed on the surface of a material such that the dyestuff is removed with minimal mechanical effort.

At FIG. 1, the SCF $CO_2$ 106 is graphically illustrated as arrows for discussion purposes only. In actuality, the SCF $CO_2$ is not separately identifiable at a macro level even though it is depicted as such in FIG. 1. Further yet, a dye material 112 and 116 is depicted as being transferred by SCF $CO_2$ 110 and 118 respectively, but as indicated, this illustration is for discussion purposes and not a scaled representation of actuality.

With respect to FIG. 1, the SCF $CO_2$ 106 is introduced to the second material 102. The initial introduction of SCF $CO_2$ 106 is without dye material associated (e.g., without dyestuff dissolved therein). The SCF $CO_2$ 106 passes through the second material 102 from the first side 120 to the second side 122, in an exemplary aspect. As the SCF $CO_2$ 106 passes through the second material 102, dye material 108 (e.g., dyestuff) for the second material 102 becomes associated (e.g., dissolved) with the SCF $CO_2$, which is depicted as the dye material 112 in connection with SCF $CO_2$ 110. The second material 102 is depicted as having a first dye profile, which may be caused by the dye material 108 of the second material 102. Alternatively, it is contemplated that the initial introduction (or at any time) of SCF $CO_2$ may transport dyestuff from a source (e.g., holding container) to the second material 102 to augment the dye profile of the second material while also augmenting the dye profile of the spooled material 104 with the dyestuff of the source and the second material 102, in an exemplary aspect.

The spooled material may be a continuous yarn-like material that is effective for use in weaving, knitting, braiding, crocheting, sewing, embroidering, and the like. Non-limiting examples of spooled material include yarn, thread, rope, ribbon, filament, and cord. It is contemplated that the spooled material may be wound about a spool (e.g., conical or cylindrical) or the spooled material may be wound about itself without a secondary support structure helping form the resulting wound shape. The spooled material may be organic or synthetic in nature. The spooled material may be a plurality of individual collections of material or a singular collection of material.

In FIG. 1, the spooled material 104 has a first surface 124 and a second surface 126. The spooled material also is depicted as having a second dye profile with dye material 114. The dye material 114 may be dyestuff transferred by the SCF $CO_2$ having passed through the second material 102 and/or it is dyestuff associated with the spooled material 104 in a previous operation, in an exemplary aspect.

As such, FIG. 1 depicts a SCF $CO_2$ dyeing operation in which SCF $CO_2$ passes through the second material 102 from the first side 120 to the second side 122 while transferring (e.g., such as dissolving dyestuff in the SCF $CO_2$) dyestuff from the second material, as depicted by dye material 112 being transported by the SCF $CO_2$ 110. The spooled material 104 receives the SCF $CO_2$ (e.g., 110) on the first side 124. The SCF $CO_2$ passes through the spooled material 104 while allowing dye material (e.g., 114) to dye the spooled material 104. The dye material dyeing the spooled material 104 may be dye material from the second material 102, in an exemplary aspect. It is further contemplated that the dye material dyeing the spooled material 104 may be dye material from additional material layers or sources. Further, the SCF $CO_2$ may pass through the spooled material 104 (e.g., SCF $CO_2$ 118) while transferring dye material (e.g., 116) therewith. This dye material 116 may be deposited with another material layer and/or the second material 102 layer. As can be appreciated, this may be a cycle in which equilibrium of dye material is achieved on the different material layers as the SCF $CO_2$ repeatedly passes through the material layers. Eventually, it is contemplated the dye material 108, 112, 114, and 116 may be indistinguishable and/or result in an indistinguishable dye profile among the different materials, in an exemplary aspect. Stated differently, as each of the various dyestuff has a different solubility within the SCF, the flow of the SCF through the various materials picks up and deposits the dyestuff creating a homogeneous blend of the dyestuff at a macro level (e.g., to the human eye). This cycle may continue until the SCF is removed from the cycle process, such as at a state change of the $CO_2$ from a SCF state.

FIG. 1 is exemplary in nature and is intended to serve as an illustration of the process without being depicted at scale. Therefore, it is understood that in actuality the dyestuff (i.e., dye material), the materials, and the SCF $CO_2$ may instead be seemingly indistinguishable to a common observer at a macro scale without special equipment, in an exemplary aspect.

Figure 2:
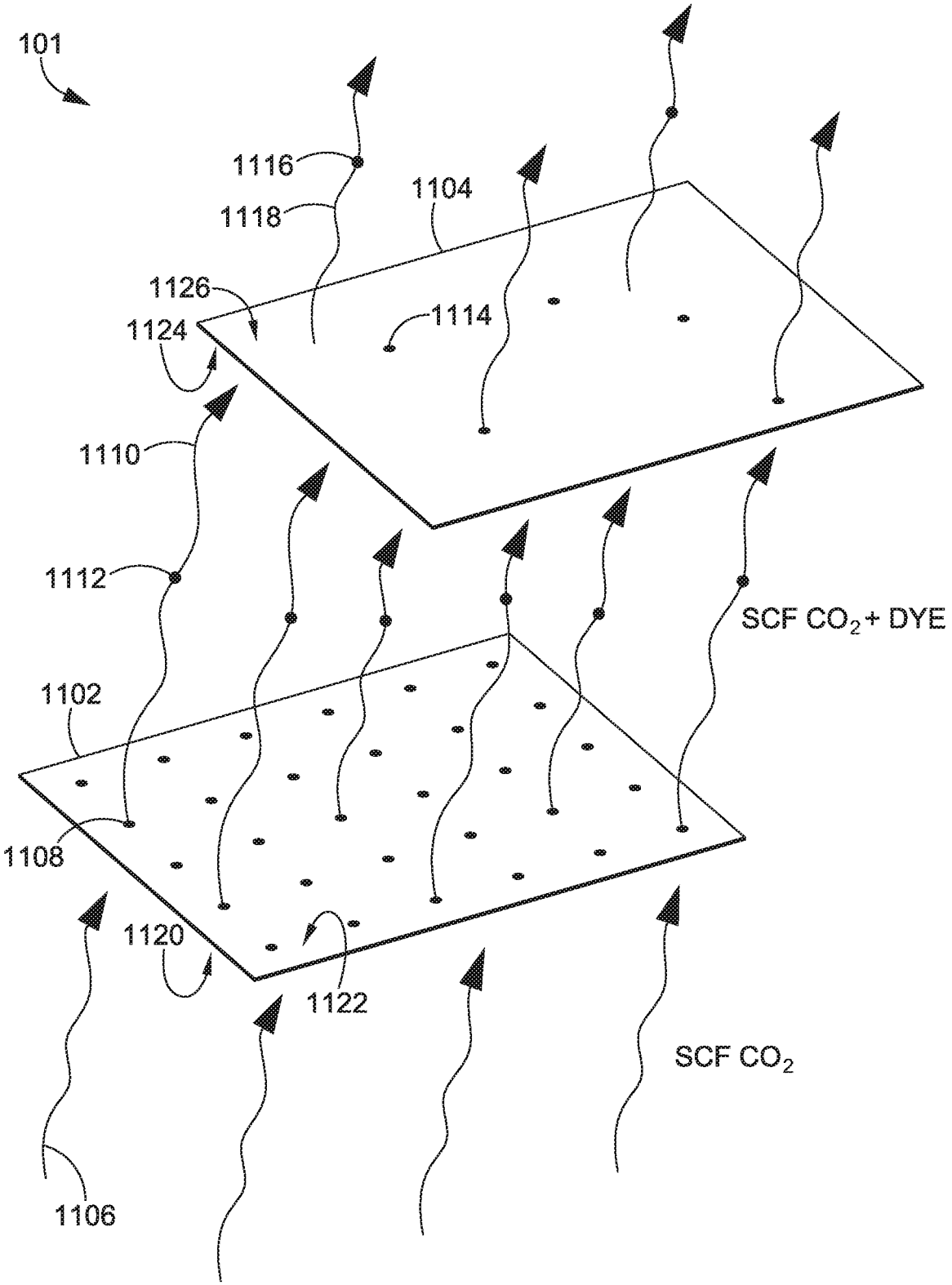
FIG. 2 is an exemplary illustration depicting the transfer of dye from a first material to a second material by way of a supercritical fluid, in accordance with an aspect hereof.

Referring now to FIG. 2, an exemplary illustration depicting the transfer of dye 101 from a first material 1102 to a second material 1104 by way of a SCF $CO_2$, in accordance with aspects hereof. A material introduced to the equilibrium dyeing with SCF $CO_2$ may be any material, such as compositions (e.g., cotton, wool, silk, polyester, and/or nylon), substrates (e.g., fabrics and/or yarns), products (e/.g., footwear and/or garments), and the like. In an exemplary aspect, the first material 1102 is a polyester material having a first dye profile comprised of dye material 1108. The first material 1102 has a first surface 1120, a second surface 1122, and a plurality of dye material 1108. The dye material 1108, which may be a composition/mixture of dyestuffs, is depicted as granular elements for discussion purposes; however, in actuality the dye material 1108 may not be individually identifiable at the macro level from the underlying substrate of a material. Also, as will be discussed hereinafter, it is contemplated that the dyestuff is integral with the material. An integral dyestuff is dyestuff that is chemically or physically bonded with the material. Integral dyestuff is compared to non-integral dyestuff, which is dyestuff that is not chemically or physically coupled with a material. An example of a non-integral dyestuff includes dry powdered dyestuff sprinkled and brushed on the surface of a material such that the dyestuff is removed with minimal mechanical effort.

At FIG. 2, the SCF $CO_2$ 1106 is graphically illustrated as arrows for discussion purposes only. In actuality, the SCF $CO_2$ is not separately identifiable at a macro level as depicted in FIG. 2. Further yet, a dye material 1112 and 1116 is depicted as being transferred by SCF $CO_2$ 1110 and 1116 respectively, but as indicated, this illustration is for discussion purposes and not a scaled representation of actuality.

With respect to FIG. 2, the SCF $CO_2$ 1106 is introduced to the first material 1102. The initial introduction of SCF $CO_2$ 1106 is without dye material associated (e.g., without dyestuff dissolved therein). The SCF $CO_2$ 1106 passes through the first material 1102 from the first side 1120 to the second side 1122, in an exemplary aspect. As the SCF $CO_2$ 1106 passes through the first material 1102, dye material 1108 (e.g., dyestuff) for the first material 1102 becomes associated (e.g., dissolved) with the SCF $CO_2$, which is depicted as the dye material 1112 in connection with SCF $CO_2$ 1110. The first material 1102 is depicted as having a first dye profile, which may be caused by the dye material 1108 of the first material 1102. Alternatively, it is contemplated that the initial introduction (or at any time) of SCF $CO_2$ may transport dyestuff from a source (e.g., holding container) to the first material 1102 to augment the dye profile of the first material while also augmenting the dye profile of the second material 1104 with the dyestuff of the source and the first material 1102, in an exemplary aspect.

The second material 1104 has a first surface 1124 and a second surface 1126. The second material also is depicted as having a second dye profile with dye material 1114. The dye material 1114 may be dyestuff transferred by the SCF $CO_2$ having passed through the first material 1102 and/or it is dyestuff associated with the second material 1104 in a previous operation, in an exemplary aspect.

As such, FIG. 2 depicts a SCF $CO_2$ dyeing operation in which SCF $CO_2$ passes through the first material 1102 from the first side 1120 to the second side 1122 while transferring (e.g., such as dissolving dyestuff in the SCF $CO_2$) dyestuff from the first material, as depicted by dye material 1112 being transported by the SCF $CO_2$ 1110. The second material 1104 receives the SCF $CO_2$ (e.g., 1110) on the first side 1124. The SCF $CO_2$ passes through the second material 1104 while allowing dye material (e.g., 1114) to dye the second material 1104. The dye material dyeing the second material 1104 may be dye material from the first material 1102, in an exemplary aspect. It is further contemplated that the dye material dyeing the second material 1104 may be dye material from additional material layers or sources. Further, the SCF $CO_2$ may pass through the second material 1104 (e.g., SCF $CO_2$ 1118) while transferring dye material (e.g., 1116) therewith. This dye material 1116 may be deposited with another material layer and/or the first material 1102 layer. As can be appreciated, this may be a cycle in which equilibrium of dye material is achieved on the different material layers as the SCF $CO_2$ repeatedly passes through the material layers. Eventually, it is contemplated the dye material 1108, 1112, 1114, and 1116 may be indistinguishable and/or result in an indistinguishable dye profile among the different materials, in an exemplary aspect. Stated differently, as each of the various dyestuff has a different solubility within the SCF, the flow of the SCF through the various materials picks up and deposits the dyestuff creating a homogeneous blend of the dyestuff at a macro level (e.g., to the human eye). This cycle may continue until the SCF is removed from the cycle process, such as at a state change of the $CO_2$ from a SCF state.

FIG. 2 is exemplary in nature and is intended to serve as an illustration of the process without being depicted at scale. Therefore, it is understood that in actuality the dyestuff (i.e., dye material), the materials, and the SCF $CO_2$ may instead be seemingly indistinguishable to a common observer at a macro scale without special equipment, in an exemplary aspect.

Further, as will be provided herein, aspects contemplate a dyestuff integral to a material. A dyestuff is integral to a material when it is physically or chemically bonded with the material, in an example. In another example, dyestuff is integral to the material when the dyestuff is homogenized on the material. The homogenization of dyestuff is in contrast to a material on which dyestuff is applied in a non-uniform manner, such as if a dyestuff is merely sprinkled or otherwise loosely applied to the material. An example of integral dyestuff with a material is when dyestuff is embedded and maintained within the fibers of a material, such as when dyestuff perfuses a material.

The term "perfuse," as used herein, is to coat, permeate, and/or diffuse surface finishes, such as dyestuff over and/or throughout a material. The perfusing of a material with dyestuff occurs in a pressure vessel, such as an autoclave, as is known in the art. Further, the SCF and dyestuff dissolved in the SCF may be circulated within the pressure vessel with a circulation pump, as is also known in the art. The circulation of SCF within the pressure vessel by a pump causes the SCF to pass through and around a material within the pressure vessel to cause dissolved dyestuff to perfuse the material. Stated differently, when a target material is perfused with SCF $CO_2$ having dyestuff (e.g., finish material) dissolved therein, the dyestuff is deposited on one or more portions of the target material. For example, a polyester material, when exposed to the conditions suitable for forming SCF $CO_2$, may "open" up allowing for portions of the dyestuff to remain embedded with the polyester fibers forming the polyester material. Therefore, adjusting the heat, pressure, circulation flow, and time affects the SCF, the dyestuff, and the target material. The variables all taken in combination, when the SCF $CO_2$ perfuses the target material, a deposit of dyestuff throughout the material may occur.

Figure 3:
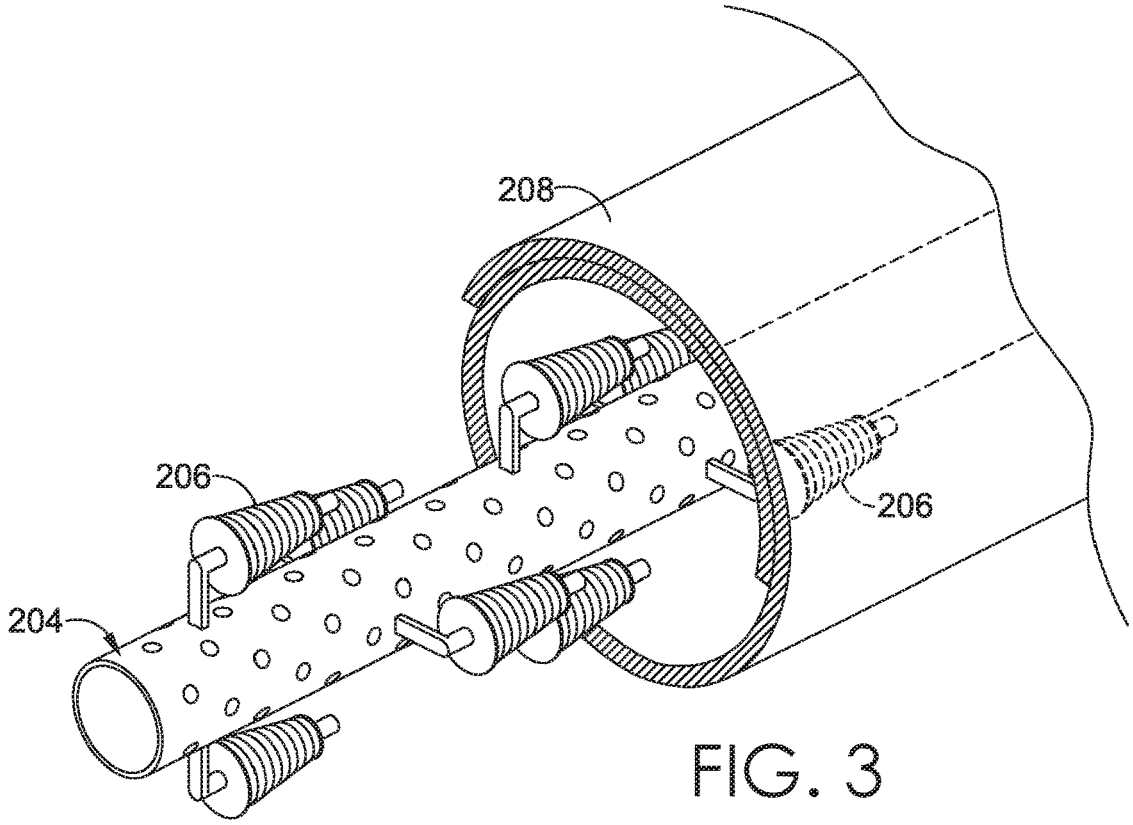
FIG. 3 depicts exemplary materials in a contacting arrangement for the perfusing of one of more materials finishes, in accordance with an aspect hereof.

FIG. 3 depicts a material holding element 204, supporting a plurality of spooled materials 206 and a second material 208, in accordance with aspects hereof. The plurality of spooled materials 206, in this example has a first dye profile. The first dye profile may be a profile that is lacking coloration or other surface finishes other than the natural state of the material, in an exemplary aspect. The plurality of spooled materials 206 may be a target material, a material intended for use in a commercial good, such as apparel or footwear. The second material 208 may be a sacrificial material having integral dyestuff. For example, the second material 208 may be a previously dyed (or otherwise treated) material.

In the example depicted in FIG. 3, which is in contrast to FIG. 4 to be discussed hereinafter, the second material 208 is in physical contact with the spooled material 206. In this example, a surface of the second material 208 is contacting a surface of the spooled material 206. The physical contact or close proximity provided by the contact, in an exemplary aspect, provides for an efficient transfer of dyestuff from the second material 208 to the spooled material 206 in the presence of SCF. Further, physical contact of the materials exposed to a SCF for dyeing purposes allows for, in an exemplary aspect, efficient use of space in a pressure vessel so that dimensions (e.g., roll length of a material) of a material may be maximized.

As depicted in FIG. 3 for exemplary purposes, the second material 208 is significantly smaller in volume than the spooled material 206. In this example, the spooled material 206 is the target material; therefore, a maximization of volume for target material may be desired. As some pressure vessels have limited volume, a portion of that limited volume consumed by a sacrificial material limits the volume useable by a target material. As such, in an exemplary aspect, a sacrificial (or plurality of sacrificial materials) are of a smaller volume (e.g., yardage) than a target material when positioned in a common pressure vessel. Further, while an exemplary material holding element 204 is depicted, it is contemplated that alternative configurations of a holding element may be implemented.

Figure 4:
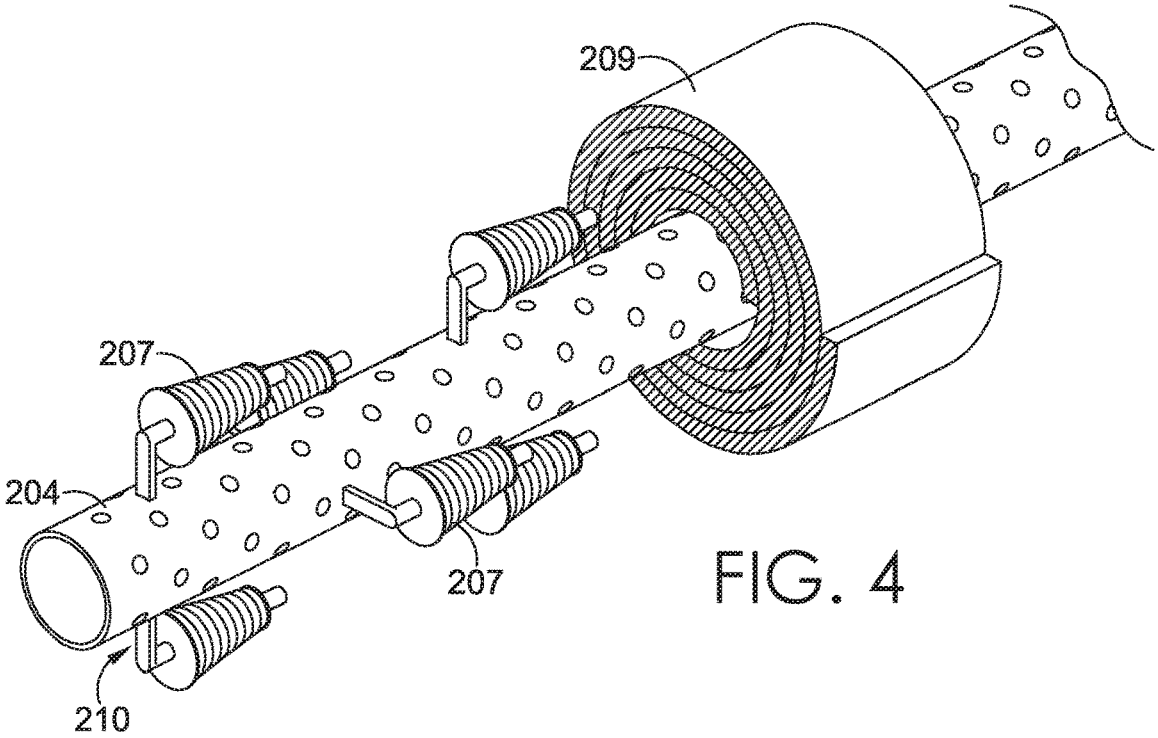
FIG. 4 depicts exemplary materials in a non-contacting arrangement for the perfusing of one of more materials finishes, in accordance with an aspect hereof.

FIG. 4 depicts a material holding element, also supporting a spooled material 207 and a second material 209, in accordance with aspects hereof. While the spooled material 207 and the second material 209 are depicted on a common holding element, it is contemplated that physically separate holding elements may be used in alternative exemplary aspects. The spooled material 207 has a first dye profile and the second material 209 has a second dye profile. In particular, at least one of the spooled material 207 or the second material 209 has an integral dyestuff. To the contrary of FIG. 3 in which close proximity or physical contact is depicted with the multiple materials, the materials of FIG. 4 are not in direct contact with one another. The lack of physical contact, in an exemplary aspect, allows for the efficient substitution and manipulation of at least one material without significant physical manipulation of the other material(s). For example, if the second material 209 has a dye profile having a first coloration is processed with the spooled material 207 such that at least some of the dyestuff of the second material perfuses the spooled material 207 in a SCF dyeing process, the second material 209 may be removed and substituted with a third material having a different dye profile (e.g., a material treatment such as DWR) that is preferred to be perfused to the spooled material 207 subsequent to the dyestuff of the second material 209. Stated differently, the physical relationship depicted and generally discussed with FIG. 4 may be efficient in manufacturing and processing as individual manipulation of the materials may be accomplished.

While the spooled material 207 and the second material 209 are depicted on a common material holding element 204, it is contemplated that the spooled material 207 is on a first holding element and the second material 209 is on a second holding element that is different from the first holding element, in an exemplary aspect.

While only two materials are depicted in FIGS. 3 and 4, it is understood that any number of materials may be simultaneously exposed to a SCF (or near SCF). For example, it is contemplated that two or more sacrificial materials having integral dyestuff are placed within a common pressure vessel with a target material intended to be perfused with the dyestuff of the sacrificial materials. Further, it is contemplated that a quantity of the materials is not limited to those proportions depicted in FIG. 3 or 4. For example, it is contemplated that a target material may be of much greater volume than a sacrificial material. Further, it is contemplated that a volume of sacrificial material may be adjusted to accomplish a desired dye profile of the target material(s). For example, depending on the dye profile of the sacrificial material (e.g., concentration, coloration, etc.) and the desired dye profile for target material in addition to the volume of the target material, the amount of sacrificial material may be adjusted to achieve a desired SCF dyeing result. Similarly, it is contemplated that the dye profile of the second material (or first material) is adjusted based on a desired dye profile and/or a volume of material included in the dyeing process.

Figure 5:
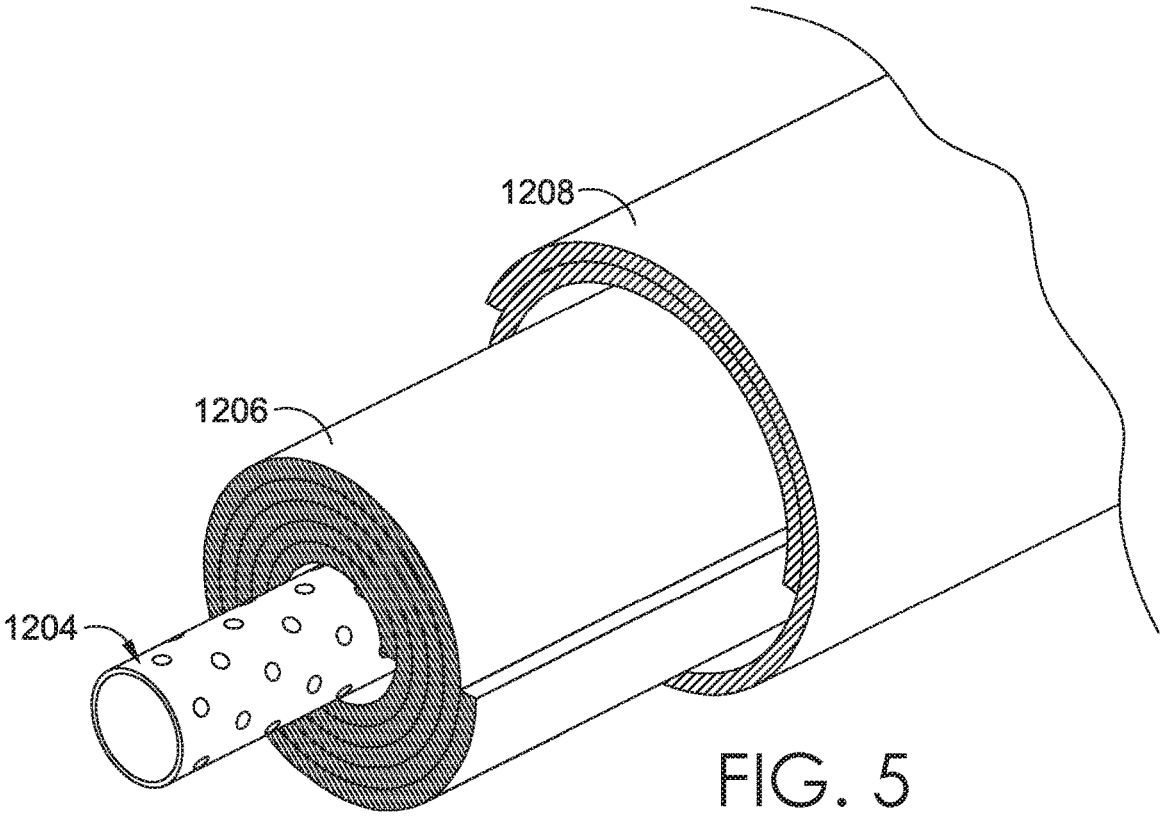
FIG. 5 depicts exemplary materials in a contacting arrangement, in accordance with an aspect hereof.

FIG. 5 depicts a material holding element, such as a beam 1204, supporting a first material 1206 and a second material 1208, in accordance with aspects hereof. The first material 1206, in this example has a first dye profile. The first dye profile may be a profile that is lacking coloration other than the natural state of the material, in an exemplary aspect. The first material 1206 may be a target material, a material intended for use in a commercial good, such as apparel or footwear. The second material 1208 may be a sacrificial material having integral dyestuff. For example, the second material 1208 may be a previously dyed (or other treatment) material.

In the example depicted in FIG. 5, which is in contrast to FIG. 6 to be discussed hereinafter, the second material 1208 is in physical contact with the first material 1206. In this example, a surface of the second material 1208 is contacting a surface of the first material 1206. The physical contact or close proximity provided by the contact, in an exemplary aspect, provides for an efficient transfer of dyestuff from the second material 1208 to the first material 1206 in the presence of SCF. Further, physical contact of the materials exposed to a SCF for dyeing purposes allows for, in an exemplary aspect, efficient use of space in a pressure vessel so that dimensions (e.g., roll length of a material) of a material may be maximized.

As depicted in FIG. 5 for exemplary purposes, the second material 1208 is significantly smaller in volume than the first material 1206. In this example, the first material 1206 is the target material; therefore, a maximization of volume for target material may be desired. As some pressure vessels have limited volume, a portion of that limited volume consumed by a sacrificial material limits the volume useable by a target material. As such, in an exemplary aspect, a sacrificial (or plurality of sacrificial materials) are of a smaller volume (e.g., yardage) than a target material when positioned in a common pressure vessel. While the second material 1208 is depicted on an outward location of the beam 1204 relative to the first material 1206, it is contemplated that the sacrificial material may be positioned more inwardly on the beam 1204 relative to a target material. Further, while an exemplary beam 1204 is depicted, it is contemplated that alternative configurations of a holding element may be implemented.

Figure 6:
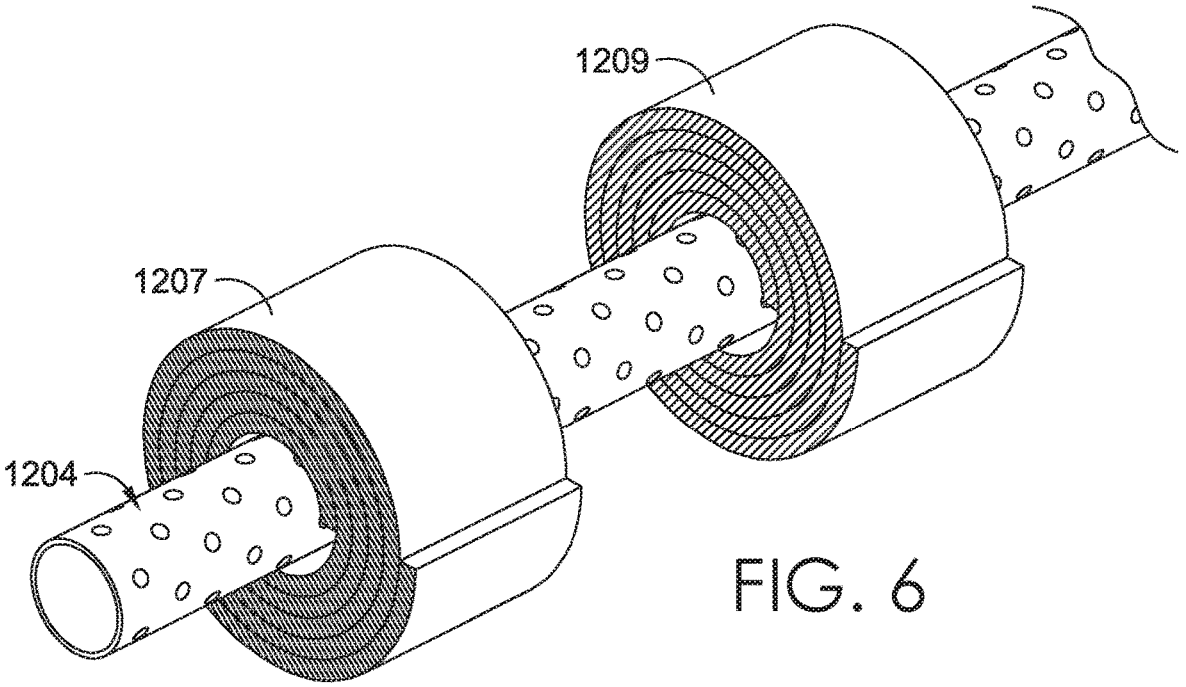
FIG. 6 depicts exemplary materials in a non-contacting arrangement, in accordance with an aspect hereof.

FIG. 6 depicts a material holding element, such as the beam 1204, also supporting a first material 1207 and a second material 1209, in accordance with aspects hereof. While the first material 1207 and the second material 1209 are depicted on a common holding element, it is contemplated that different holding elements may be used in alternative exemplary aspects. The first material 1207 has a first dye profile and the second material 1209 has a second dye profile. In particular, at least one of the first material 1207 or the second material 1209 has an integral dyestuff. To the contrary of FIG. 5 in which close proximity or physical contact is depicted with the multiple materials, the materials of FIG. 6 are not in direct contact with one another. The lack of physical contact, in an exemplary aspect, allows for the efficient substitution and manipulation of at least one material without significant physical manipulation of the other material(s). For example, if the second material 1209 has a dye profile having a first coloration is processed with the first material 1207 such that at least some of the dyestuff of the second material perfuses the first material 1207 in a SCF dyeing process, the second material 1209 may be removed and substituted with a third material having a different dye profile (e.g., a material treatment such as DWR) that is preferred to be perfused to the first material 1207 subsequent to the dyestuff of the second material 1209. Stated differently, the physical relationship depicted and generally discussed with FIG. 6 may be efficient in manufacturing and processing as individual manipulation of the materials may be accomplished, in an exemplary aspect.

While the first material 1207 and the second material 1209 are depicted as having a similar volume of material, it is contemplated that the first material 1207 may have a substantially greater volume of material than the second material 1209, which may serve as a sacrificial material in an exemplary aspect. Further, while the first material 1207 and the second material 1209 are depicted on a common holding element, it is contemplated that the first material 1207 is on a first holding element and the second material 1209 is on a second holding element that is different from the first holding element, in an exemplary aspect.

While only two materials are depicted in FIGS. 5 and 6, it is understood that any number of materials may be simultaneously exposed to a SCF (or near SCF). For example, it is contemplated that two or more sacrificial materials having integral dyestuff are placed within a common pressure vessel with a target material intended to be perfused with the dyestuff of the sacrificial materials. Further, it is contemplated that a quantity of the materials is not limited to those proportions depicted in FIG. 5 or 6. For example, it is contemplated that a target material may be of much greater volume than a sacrificial material. Further, it is contemplated that a volume of sacrificial material may be adjusted to accomplish a desired dye profile of the target material(s). For example, depending on the dye profile of the sacrificial material (e.g., concentration, coloration, etc.) and the desired dye profile for target material in addition to the volume of the target material, the amount of sacrificial material may be adjusted to achieve a desired SCF dyeing result. Similarly, it is contemplated that the dye profile of the second material (or first material) is adjusted based on a desired dye profile and/or a volume of material included in the dyeing process.

Figure 7:
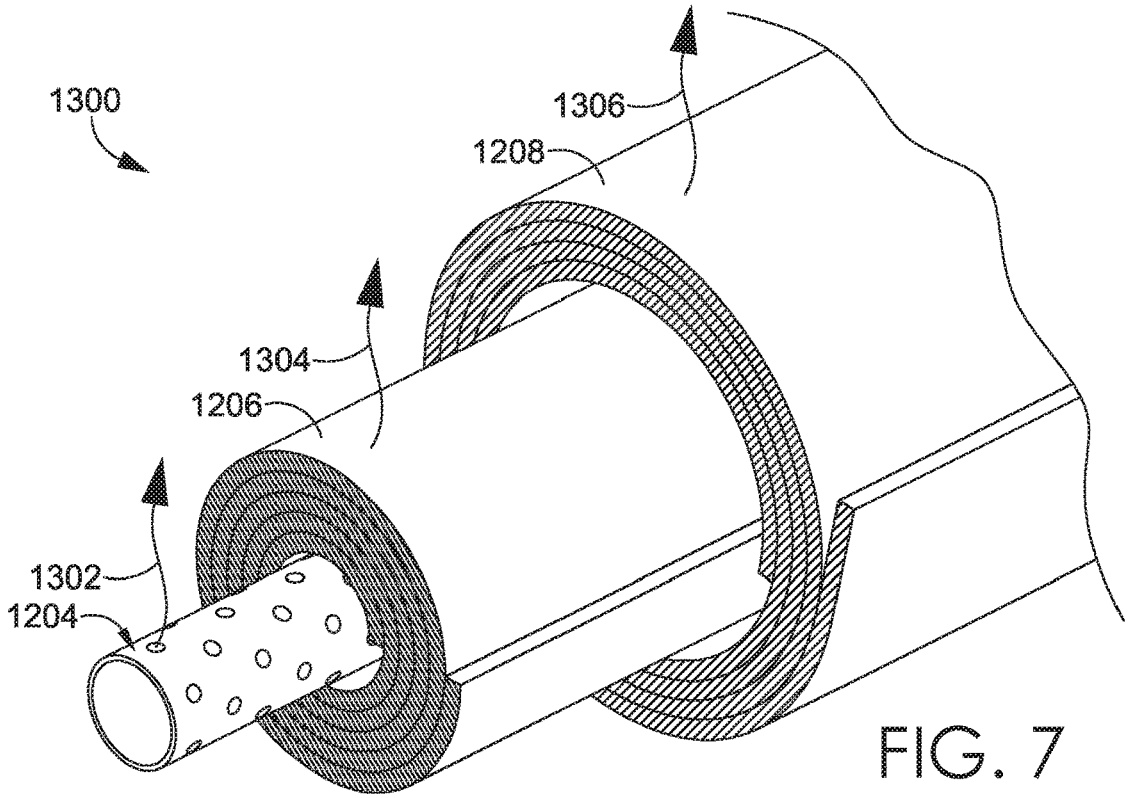
FIG. 7 depicts a series winding of two materials around a beam, in accordance with an aspect hereof.
Figure 8:
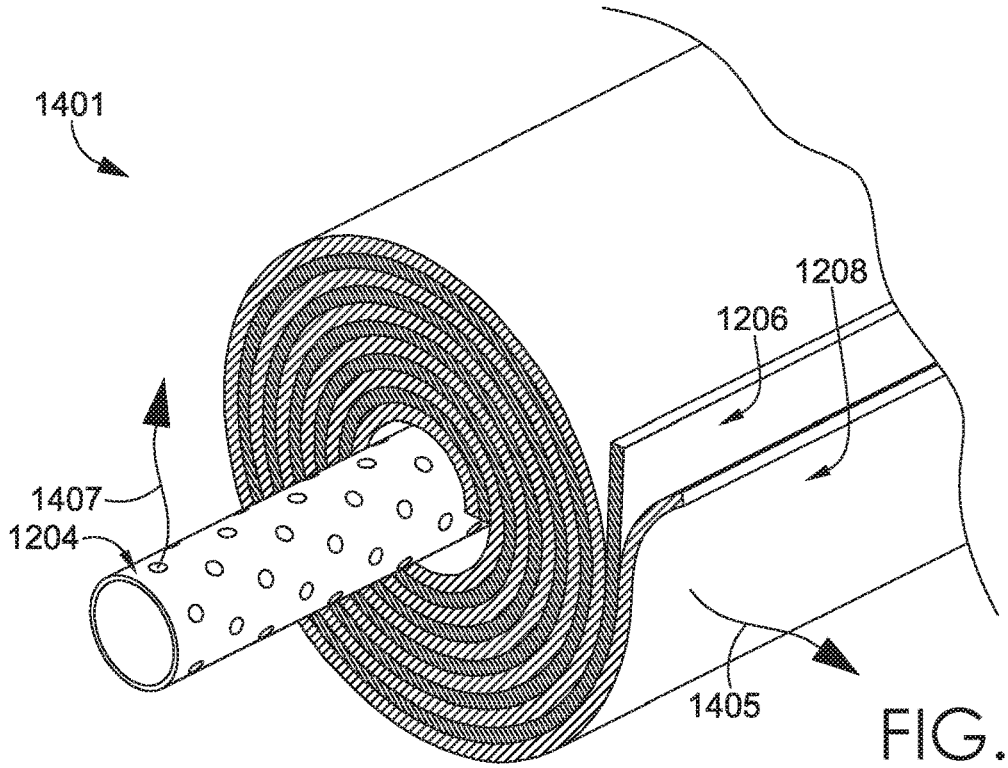
FIG. 8 depicts contemporaneously wound materials around a beam, in accordance with an aspect hereof.

As has been illustrated in FIGS. 5 and 6 and will be illustrated in FIGS. 7 and 8, various engagements of the first material and the second material about the holding device are contemplated. As previously provided, the first material 1206 and/or the second material 1208 may be any material fabric that is knit, woven, or otherwise constructed. They may be formed from any material organic or synthetic. They may have any dye profile, in an exemplary aspect. The dye profile may comprise any dye type formed from any dyestuff. In an exemplary aspect, the first material 1206 and the second material 1208 are a polyester woven material.

The SCF $CO_2$ allows the polyester to be dyed with a modified dispersed dyestuff. This occurs because the SCF $CO_2$ and/or the conditions causing the SCF state of $CO_2$ result in the polyester fibers of the materials to swell, which allows the dyestuff to diffuse and penetrate the pore and capillary structures of the polyester fibers. It is contemplated that reactive dye may similarly be used when one or more of the materials is cellulosic in composition. In an exemplary aspect, the first material 1206 and the second material 1208 are formed from a common material type such that dyestuff is effective for dyeing both materials. In an alternative aspect, such as when one of the materials is sacrificial in nature as a dye carrier, the dyestuff may have a lower affinity for the sacrificial material than the target material, which could increase the speed of SCF $CO_2$ dyeing. An example may include the first material being cellulosic in nature and the second material being a polyester material and the dyestuff associated with the first material being a dispersed dye type such that the dyestuff has a greater affinity for the polyester material (in this example) over the first material. In this example, a reduced dyeing time may be experienced to achieve a desired dye profile of the second material.

Figure 10:
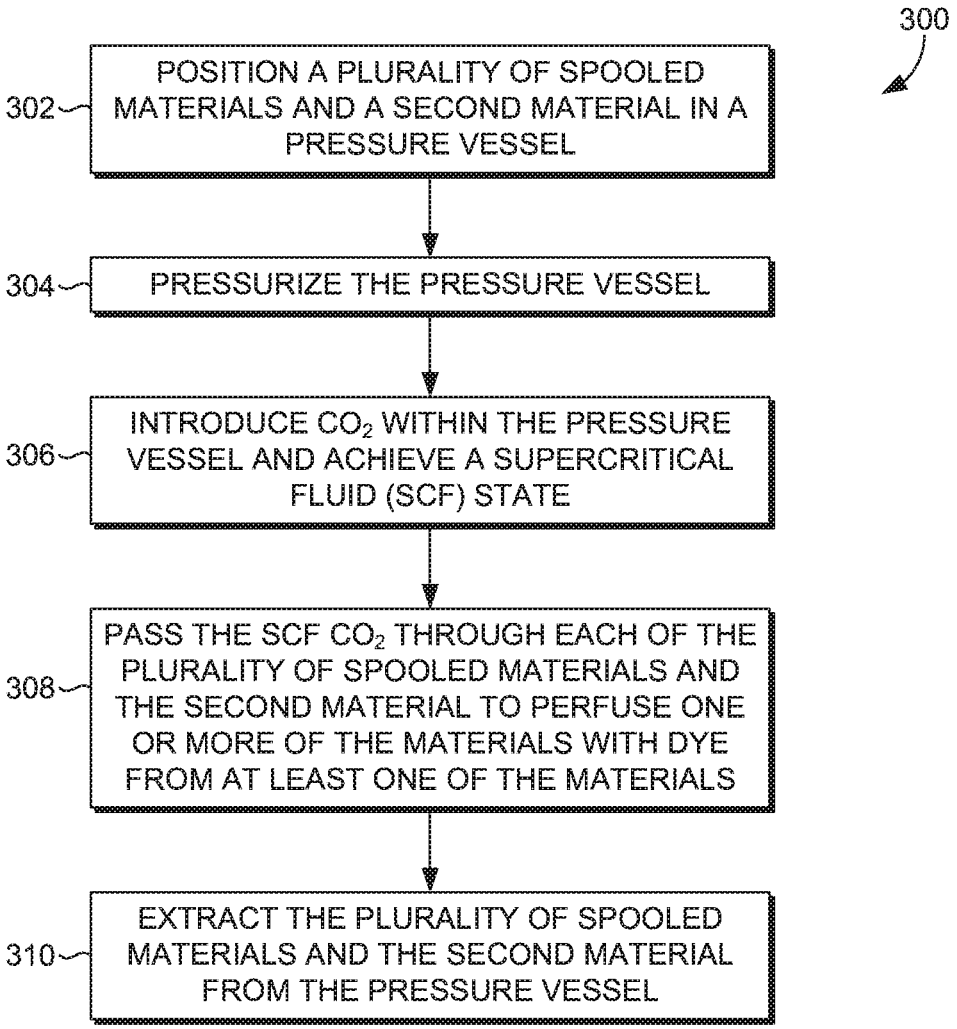
FIG. 10 depicts a flow chart representing an exemplary method of applying a dye to a spooled material using supercritical fluid, in accordance with an aspect hereof.

FIG. 10 depicts a flow chart 300 of an exemplary method of dyeing a spooled material, such as those depicted in FIGS. 1, 3, and 4, in accordance with aspects hereof. At a block 302, a plurality of spooled materials and a second material are positioned in a pressure vessel. In an exemplary aspect, the spooled material may be maintained on a securing apparatus that allows for a plurality of spooled materials to be positioned in the pressure vessel at a common time. Additionally, it is contemplated that the securing apparatus is effective to position the spooled materials in an appropriate position relative to the internal walls of the pressure vessel as well as the relative to other spooled materials. In an exemplary aspect, avoiding contact with the internal walls of the pressure vessel by a material to be perfused with a material finish allows for the material to be perfused with the material finish. As previously discussed, the spooled materials may be wound about a beam prior to being positioned in the vessel. The materials may be positioned within the vessel by moving the materials as a common grouping into the pressure vessel. Also, it is contemplated that the material may be maintained on the securing apparatus in a variety of manners (e.g., in a vertical, in a stacked, in a horizontal, and/or in an offset manner). Further, it is contemplated that the materials may be maintained on different securing devices and positioned in a common pressure vessel.

At a block 304, the pressure vessel may be pressurized. In an exemplary aspect, the materials are loaded into the pressure vessel and then the pressure vessel is sealed and pressurized. In order to maintain inserted $CO_2$ in the SCF phase, the pressure, in an exemplary aspect, is raised above the critical point (e.g., 73.87 bar).

Regardless of how the pressure vessel is brought to pressure, at a block 306, SCF $CO_2$ is introduced into the pressure vessel. This SCF $CO_2$ may be introduced by transitioning $CO_2$ maintained in the pressure vessel from a first state (i.e., liquid, gas, or solid) into a SCF state. As know, the state change may be accomplished by achieving a pressure and/or temperature sufficient for a SCF phase change. It is contemplated that one or more heating elements are engaged to raise the internal temperature of the pressure vessel to a sufficient temperature (e.g., 304 K, 30.85 C). One or more heating elements may also heat the $CO_2$ as (or before) it is introduced into the pressure vessel, in an exemplary aspect.

At a block 308, the SCF $CO_2$ is passed through each of the plurality of spooled materials and the second material. While the SCF $CO_2$ passes through the materials, which may have different dye profiles, dyestuffs is transferred between the materials and perfuse the material(s). In an exemplary aspect, the dyestuff is dissolved in the SCF $CO_2$ such that the SCF $CO_2$ serves as a solvent and carrier for the dyestuff. Further, because of the temperature and pressure of the SCF $CO_2$, the materials may alter (e.g., expand, open, swell), temporarily, to be more receptive to dyeing by the dyestuff.

It is contemplated that the passing of SCF $CO_2$ is a cycle in which the SCF $CO_2$ is passed through the materials multiple times, such as in a closed system with a circulation pump, in an exemplary aspect. It is this circulation that may help achieve the dyeing. In an aspect, the SCF is circulated through the materials for a period of time (e.g., 60 minutes, 90 minutes, 120 minutes, 180, minutes, 240 minutes) and then the SCF $CO_2$ is allowed to change state (e.g., to a liquid $CO_2$) by dropping temperature and/or pressure. After changing state of the $CO_2$ from SCF state, the dyestuff is no longer soluble in the non-SCF $CO_2$, in an exemplary aspect. For example, dyestuff may be soluble in SCF $CO_2$, but when the $CO_2$ transitions to liquid $CO_2$, the dyestuff is no longer soluble in the liquid $CO_2$.

At a block 310, the plurality of spooled materials and the second material are extracted from the pressure vessel. In an exemplary aspect, the pressure within the pressure vessel is reduced to near atmospheric pressure and the $CO_2$ is recaptured from the pressure vessel for potential reuse in subsequent dyeing operations. In an example, a securing apparatus securing the materials may be moved out of the vessel after a desired dye profile is achieved for one or more of the materials.

While specific steps are discussed and depicted in FIG. 10, it is contemplated that one or more additional or alternative steps may be introduced to achieve aspects hereof. Further, it is contemplated that one or more of the listed steps may be omitted altogether to achieve aspects provided herein.

Figure 11:
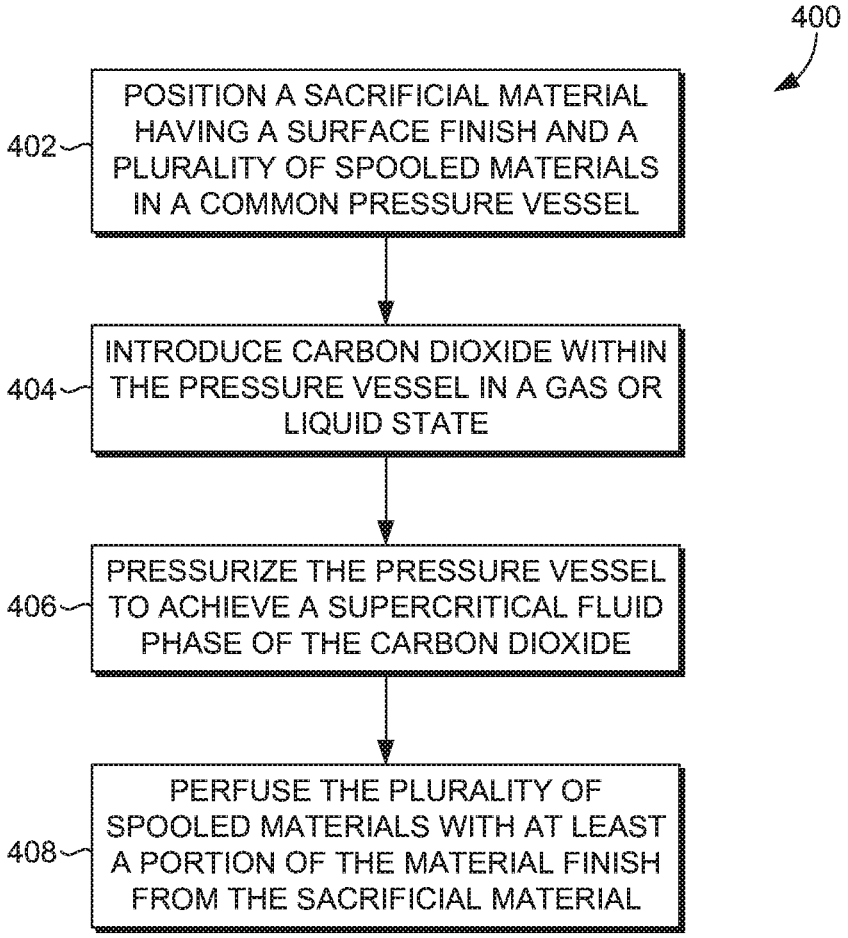
FIG. 11 depicts a flow chart representing an exemplary method of applying a material finish to a spooled material using supercritical fluid, in accordance with an aspect hereof.

FIG. 11 depicts a flow diagram 400 depicting an exemplary method of applying a material finish to a spooled material with a sacrificial material, in accordance with aspects herein. At a block 402, a sacrificial material having a surface finish and a plurality of spooled materials are positioned in a common pressure vessel. As previously discussed, the positioning may be manual or automated. The positioning may also be accomplished by used of moving a common securing apparatus to which the sacrificial material and/or one or more of the plurality of spooled materials are secured for positioning. It is contemplated that the sacrificial material is in contact with or physically separated from the spooled material when being positioned in the pressure vessel.

As previously discussed, it is contemplated that the material finish of the sacrificial material may be a colorant (e.g., dyestuff), a hydrophilic finish, a hydrophobic finish, and/or an anti-microbial finish. As will be illustrated in FIG. 12 hereinafter, it is contemplated that multiple sacrificial materials may be positioned within the pressure vessel at a common time with the plurality of spooled materials. Alternatively, it is contemplated that a sacrificial material may include more than one material finish intended to be applied to the plurality of spooled materials. For example, both a colorant and a hydrophilic finish may be maintained by the sacrificial material and applied to the spooled materials through the perfusing of SCF, in an exemplary aspect.

At a block 404, carbon dioxide is introduced into the pressure vessel. The $CO_2$ may be in a liquid or gas state when it is introduced. Further, it is contemplated that the pressure vessel is enclosed at the time of the $CO_2$ introduction to maintain the $CO_2$ within the pressure vessel. The pressure vessel may be at atmospheric pressure when the $CO_2$ is introduced. Alternatively, the pressure vessel may be above or below atmospheric pressure when the $CO_2$ is introduced.

At a block 406, the pressure vessel is pressurized allowing the introduced $CO_2$ to achieve a SCF (or near) state. Additionally, it is contemplated that thermal energy is applied to (or within) the pressure vessel to aid in achieving the SCF state of the $CO_2$. As discussed hereinabove, the state diagram of FIG. 9 depicts a trend between temperature and pressure to achieve a SCF state. In an aspect, the pressure vessel is pressurized to at least 73.87 bar. This pressurization may be accomplished by injection of atmospheric air and/or $CO_2$ until the internal pressure of the pressure vessel reaches the desired pressure, such as at least the critical point pressure of $CO_2$.

At a block 408, the plurality of spooled materials are perfused with at least a portion of the material finish from the sacrificial material. The material finish is transferred to the plurality of spooled materials by way of the SCF $CO_2$. As discussed previously, the SCF $CO_2$ serves as a transportation mechanism for the material finish from the sacrificial material to the plurality of spooled materials. This may be assisted by circulating, such as by a circulation pump, the SCF within the pressure vessel so that it perfuses both the sacrificial material and the plurality of spooled materials. It is contemplated that the material finish may dissolve, at least partially, within the SCF allowing for their release from being bound with the sacrificial material to being deposited on/within the plurality of spooled materials. To ensure consistent application of the material finish to the plurality of spooled materials, the material finish may be integral to the sacrificial material, which ensures the intended amount of material finish is introduced within the pressure vessel. The transfer of the material finish may continue until a sufficient amount of the material finish perfuses the spooled materials.

While specific reference in FIG. 11 is made to one or more steps, it is contemplated that one or more additional or alternative steps may be implemented while achieving aspects provided herein. As such, blocks may be added or omitted while still staying within the scope hereof.

Figure 12:
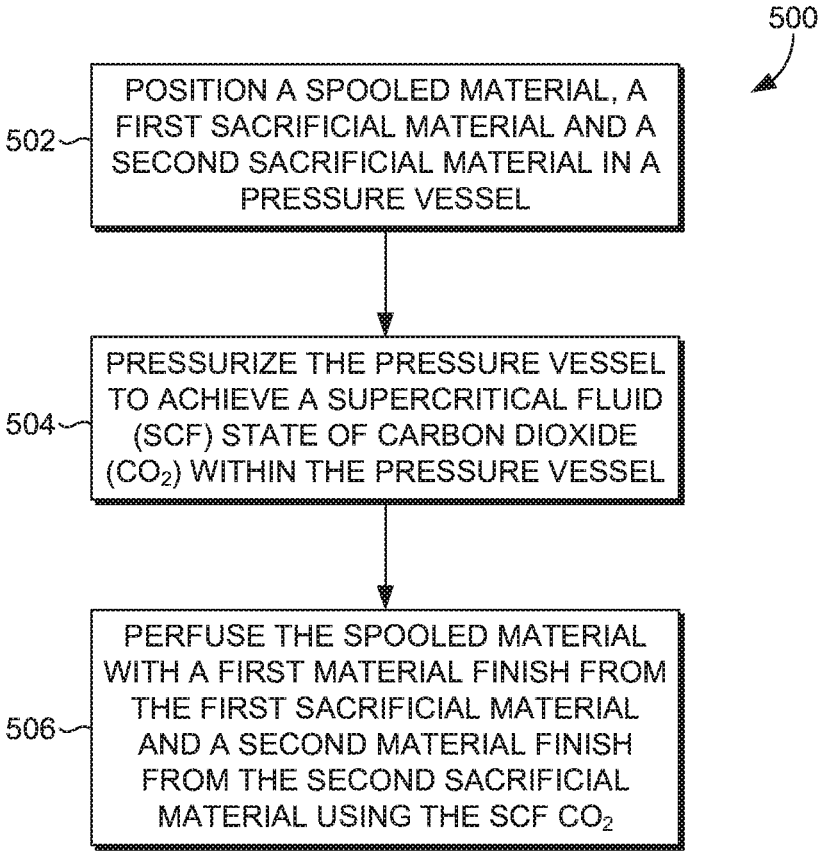
FIG. 12 depicts a flow chart representing an exemplary method of applying a first material finish and a second material finish to a spooled material using supercritical fluid, in accordance with an aspect hereof.

FIG. 12 depicts a flow diagram 500 illustrating a method of applying at least two material finishes to a spooled material from a first and a second sacrificial material, in accordance with aspects herein. A block 502 depicts a step of positioning a spooled material, a first sacrificial material and a second sacrificial material in a common pressure vessel. The first sacrificial material having a first material finish and the second sacrificial material having a second material finish. For example, as provided above, it is contemplated that the first material finish is a first dye profile and the second material finish is a second dye profile, that when perfused with the spooled material, results in a third dye profile. The previous example applies here as well where the first dye profile is a red colorant and the second dye profile is a blue colorant such that when both the red and blue colorants perfuse the spooled material, the spooled material assumes a purple coloration. In an alternative example, the first material finish may be an anti-bacterial finish and the second material finish may be a hydrophobic material finish, such that the spooled material acquires both material finishes in a common application process, which reduces finishing time. While specific material finishes are provided in combination, it is recognized that any combination may be exposed to the SCF at a common time for application to the spooled material.

While a first and a second sacrificial material are discussed, any number of sacrificial materials may be provided. Further, it is contemplated that a quantity of the first sacrificial material and a quantity of the second sacrificial material are different depending on a desired amount of each material finish desired to be applied to the spooled material. Further, it is contemplated that the sacrificial materials will also maintain a portion of the material finish from the other materials within the pressure vessel. Therefore, it is contemplated the volume of all materials, include sacrificial, are considered when determining a quantity of surface finish to be inserted in the pressure vessel.

At a block 504, the pressure vessel is pressurized such that $CO_2$ within the pressure vessel achieves a SCF state therein. The SCF is then effective to administer the material finish of the first sacrificial material and the second material finish of the second material to the spooled material, as depicted in a block 506.

While specific reference in FIG. 12 is made to one or more steps, it is contemplated that one or more additional or alternative steps may be implemented while achieving aspects provided herein. As such, blocks may be added or omitted while still staying within the scope hereof.

FIG. 7 depicts a first exemplary winding 1300 of multiple materials having surface contact with one another on a beam 1204 for equilibrium dyeing, in accordance with aspects hereof. The winding 1300 is comprised of the beam 1204, the first material 1206, and the second material 1208. The first material 1206 and the second material 1208 are cross-sectioned to illustrate the relative location to the beam 1204. In this winding, the entirety of the first material 1206 is wound around the beam 1204 prior to the second material 1208 being wound around the first material 1206. Stated differently, SCF $CO_2$ 1302 passes through substantially the wound thickness of the first material 1206 before passing through the second material 1208 as SCF $CO_2$+dye 1304. The SCF $CO_2$ is then expelled from the second material 1208 as SCF $CO_2$+dye 1306, which may then be recirculated through one or more additional or other materials (e.g., first material 1206). Therefore, a cycle is formed in which the SCF $CO_2$+dye perfuse the materials within the pressure vessel until the temperature or pressure are changed such that the SCF changes state, at which time, the dyestuff will become integral with the material with which it was in contact at the time of the SCF state change, in an exemplary aspect.

In this illustrated example, the last turn of the first material 1206 exposes a surface that is in direct contact with a surface of the first turn of the second material 1208. Stated differently, the depicted series rolling of winding 1300 allows for a limited, but available, direct contact between the first material 1206 and the second material 1208. This direct contact can be distinguished over alternative aspects in which a dye carrier or the dyestuff is physically separate from the material to be dyed. As such, the direct contact between the materials to be dyed and having the dyestuff may reduce dyeing time and reduce potential cleaning and maintenance times, in an exemplary aspect.

FIG. 8 depicts a second exemplary winding 1401 of multiple materials on a beam 1204 for SCF dyeing, in accordance with aspects hereof. The winding 1401 is comprised of the beam 1204, the first material 1206, and the second material 1208. The first material 1206 and the second material 1208 are cross-sectioned to illustrate the relative location to the beam 1204. In this winding, the first material 1206 is contemporaneously wound around the beam 1204 with the second material 1208. Stated differently, SCF $CO_2$ 1407 passes through alternating layers of the first material 1206 and the second material 1208 allowing for multiple direct contact between the materials as multiple turns of each material are contact the other material as they wind about the beam 1204. In this example, the SCF $CO_2$ 1407 transfers dye between the materials achieving transfer of dyestuff in potentially a shorter cycle because of the consistent distance from dyestuff source and target (e.g., 1 material thickness distance). SCF $CO_2$+dye 1405 may expel from the materials (e.g., second material 1208) for recirculation through the materials and further propagation of the equilibrium of dyestuff.

While only two materials are depicted in FIGS. 7 and 8, it is contemplated that any number of materials may be wound relative to one another in any manner, in additional exemplary aspects. Further, it is contemplated that a combination of physical arrangement may be implemented with respect to the materials. For example, it is contemplated that two or more sacrificial materials may be arranged as depicted in FIG. 7 or 8 while a target material is not in contact with the sacrificial material. Stated differently, it is contemplated that one or more materials may be in physical contact with one another while one or more materials may be physically separate from one another in a common pressure vessel for a common SCF dyeing process, in accordance with aspects hereof.

Figure 13:
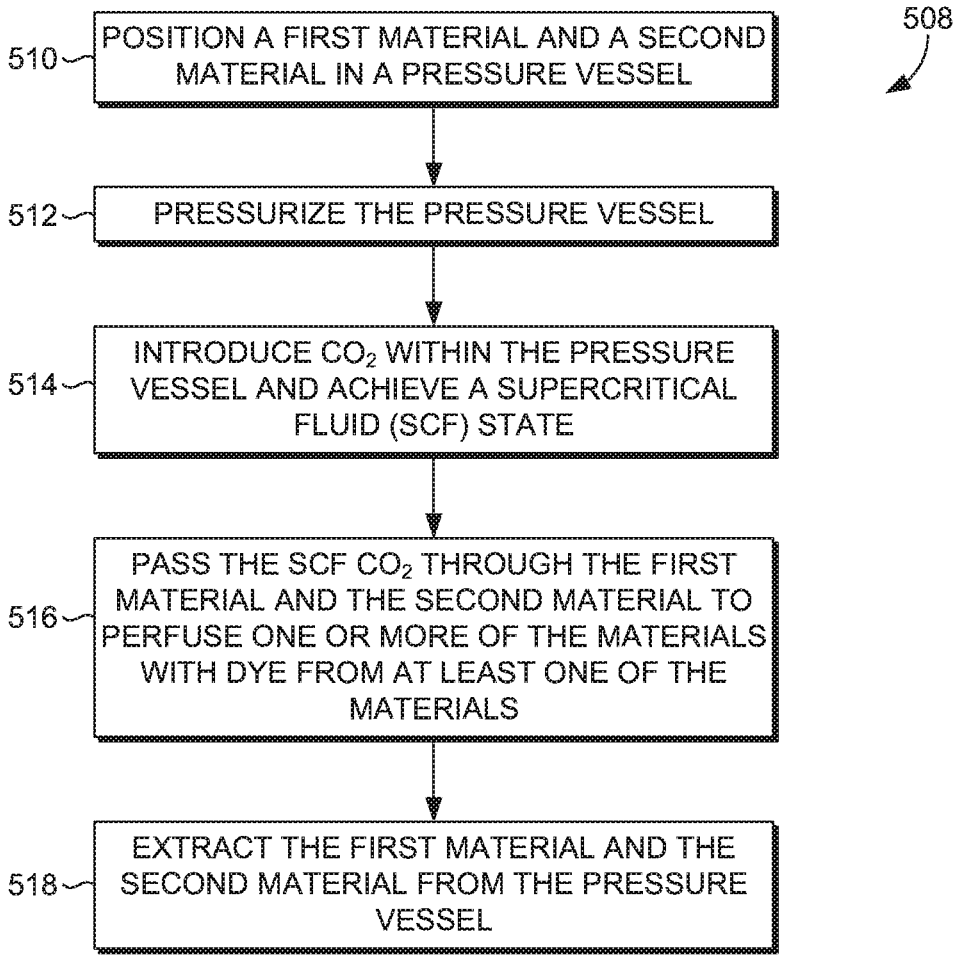
FIG. 13 depicts a flow chart illustrating a method for dyeing material with a supercritical fluid, in accordance with an aspect hereof.

FIG. 13 depicts a flow chart 508 of an exemplary method of equilibrium dyeing a material, in accordance with aspects hereof. At a block 510, a first material and a second material are positioned in a pressure vessel. As previously discussed, the materials may be wound about a beam prior to being positioned in the vessel. The materials may be positioned by moving the materials as rolled together into the pressure vessel. Also, it is contemplated that the material may be wound about a beam in a variety of manners (e.g., in series, in parallel). Further, it is contemplated that the materials may be maintained on different holding devices and positioned in a common pressure vessel.

At a block 512, the pressure vessel may be pressurized. In an exemplary aspect, the materials are loaded into the pressure vessel and then the pressure vessel is sealed and pressurized. In order to maintain inserted $CO_2$ in the SCF phase, the pressure, in an exemplary aspect, is raised above the critical point (e.g., 73.87 bar).

Regardless of how the pressure vessel is brought to pressure, at a block 514, $CO_2$ is introduced (or recirculated) into the pressure vessel. This $CO_2$ may be introduced by transitioning $CO_2$ maintained in the pressure vessel from a first state (i.e., liquid, gas, or solid) into a SCF state. As know, the state change may be accomplished by achieving a pressure and/or temperature sufficient for a SCF phase change. It is contemplated that one or more heating elements are engaged to raise the internal temperature of the pressure vessel to a sufficient temperature (e.g., 304 K, 30.85 C). One or more heating elements may also (or alternatively) heat the $CO_2$ as (or before) it is introduced into the pressure vessel, in an exemplary aspect. The introduction of $CO_2$ may occur during pressurization, prior to pressurization, and/or subsequent to pressurization.

At a block 516, the SCF $CO_2$ is passed through the first material and the second material. In an exemplary aspect, the SCF $CO_2$ is pumped into a beam about which one or more of the materials are wound. The SCF $CO_2$ is expelled from the beam into the materials. While the SCF $CO_2$ passes through the materials, which may have different dye profiles, dyestuffs is transferred between the materials and perfuse the material(s). In an exemplary aspect, the dyestuff is dissolved in the SCF $CO_2$ such that the SCF $CO_2$ serves as a solvent and carrier for the dyestuff. Further, because of the temperature and pressure of the SCF $CO_2$, the materials may alter (e.g., expand, open, swell), temporarily, to be more receptive to dyeing by the dyestuff.

It is contemplated that the passing of SCF $CO_2$ is a cycle in which the SCF $CO_2$ is passed through the materials multiple times, such as in a closed system with a circulation pump, in an exemplary aspect. It is this circulation that may help achieve the dyeing. In an aspect, the SCF is circulated through the materials for a period of time (e.g., 60 minutes, 90 minutes, 120 minutes, 180, minutes, 240 minutes) and then the SCF $CO_2$ is allowed to change state (e.g., to a liquid $CO_2$) by dropping temperature and/or pressure. After changing state of the $CO_2$ from SCF state, the dyestuff is no longer soluble in the non-SCF $CO_2$, in an exemplary aspect. For example, dyestuff may be soluble in SCF $CO_2$, but when the $CO_2$ transitions to liquid or gas $CO_2$, the dyestuff may no longer be soluble in the liquid or gas $CO_2$. It is further contemplated that the $CO_2$ is circulated internally (e.g., passed through a material holder or a beam) and/or the $CO_2$ is circulated as a recapture process to reduce lost $CO_2$ during phase changes (e.g., depressurization).

At a block 518, the first material and the second material are extracted from the pressure vessel. In an exemplary aspect, the pressure within the pressure vessel is reduced to near atmospheric pressure and the $CO_2$ is recaptured from the pressure vessel for potential reuse in subsequent dyeing operations. In an example, a beam having the materials wound thereon may be moved out of the vessel after a desired dye profile is achieved for one or more of the materials.

While specific steps are discussed and depicted in FIG. 13, it is contemplated that one or more additional or alternative steps may be introduced to achieve aspects hereof. Further, it is contemplated that one or more of the listed steps may be omitted altogether to achieve aspects provided herein.

Figure 14:
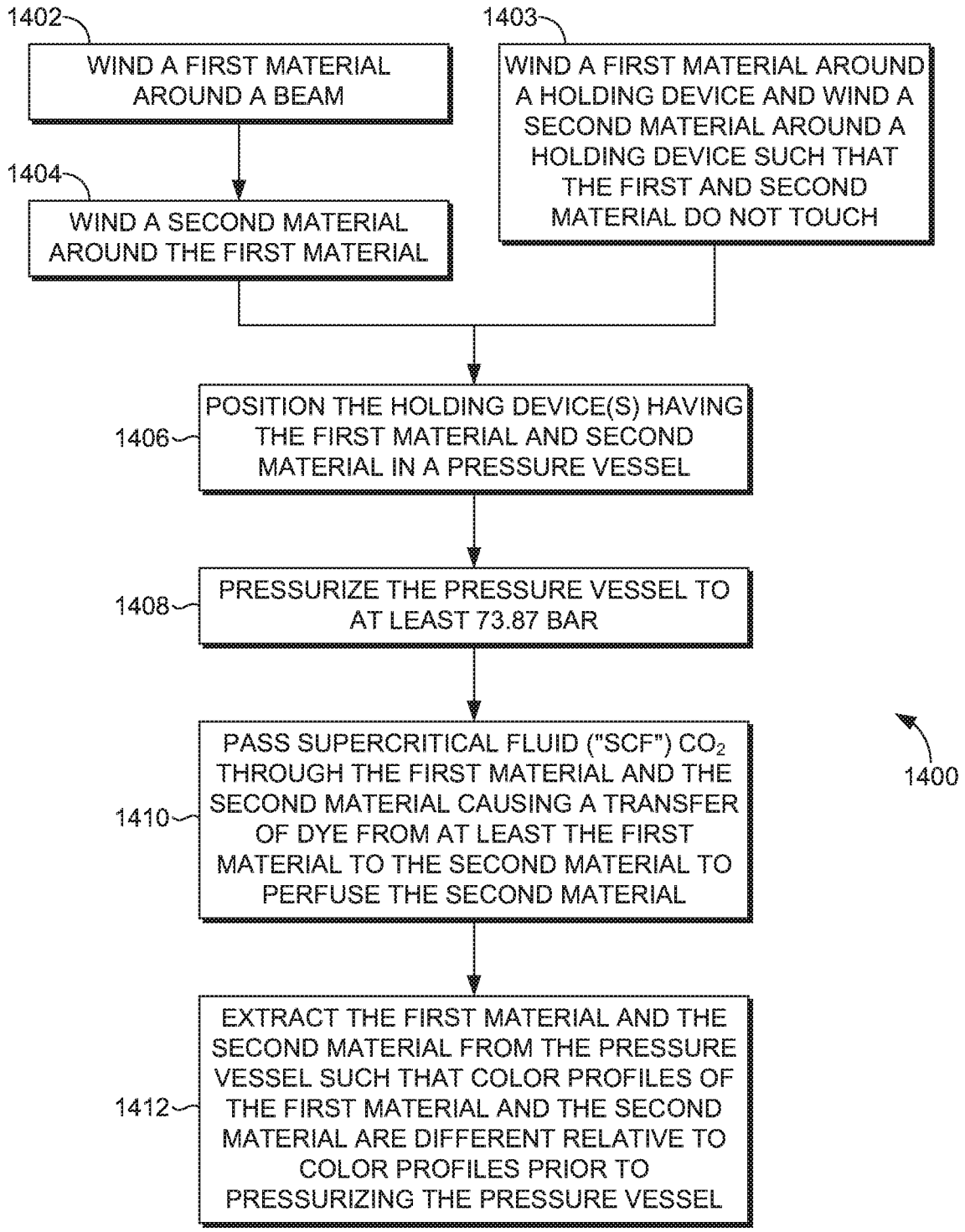
FIG. 14 depicts a flow chart illustrating another method for dyeing material with a supercritical fluid, in accordance with an aspect hereof.

FIG. 14 depicts a flow chart 1400 of a method for dyeing materials with SCF $CO_2$, in accordance with aspects hereof. The method has at least two different starting positions. A first approach, as indicated at block 1402, is a winding of a first material around a beam. At a block 1404, a second material is wound around the first material from the block 1402. The blocks 1402 and 1404 may result in a winding similar to that which is generally depicted in FIG. 7 or 8.

In the alternative, the second starting position of FIG. 14 is represented at a block 1403 with the winding of a first material about a holding device, such as a beam, and the winding of a second material about a holding device, which may be the same or different holding device on to which the first material was placed. In the step depicted at the block 1403, the first material and the second material are not in physical contact with each other. The step provided by the block 1403 may result in a material positioning that is generally depicted in FIG. 6.

In both the first and the second starting positions, the multiple materials are wound, in one manner or another, about one or more holding devices for positioning in a common pressure vessel, as depicted at a block 1406.

At a block 1408 the pressure vessel is pressurized to at least 73.87 bar. This pressurization may be accomplished by injection of atmospheric air and/or $CO_2$ until the internal pressure of the pressure vessel reaches the desired pressure, such as at least the critical point pressure of $CO_2$. For example, $CO_2$ is inserted into the pressure vessel with a pump until the appropriate pressure is achieved within the pressure vessel.

At a block 1410, SCF $CO_2$ is passed through the first material and the second material to cause a change in a dye profile for at least one of the first material or the second material. The dye transfer may be continued until the dyestuffs perfuse the materials(s) sufficiently to achieve a desired dye profile. An internal recirculating pump is contemplated as being effective to cycle the SCF $CO_2$ through the beam and wound materials multiple times to achieve the equilibrium dyeing, in an exemplary aspect. This internal recirculating pump may be adjusted to achieve a desired flow rate of the SCF $CO_2$. The flow rate provided by the internal recirculating pump may be affected by the amount of material, the density of material, the permeability of the material, and the like.

At a block 1412, the first material and the second material are extracted from the pressure vessel such that color profiles (e.g., dye profile) of the materials are different relative to the color profiles of the materials as existed at blocks 1402, 1403, or 1404. Stated differently, upon completion of the SCF $CO_2$ passing through the materials, the dye profiles of at least one of the materials changes to reflect that it has been dyed by SCF $CO_2$.

While specific reference in FIG. 14 is made to one or more steps, it is contemplated that one or more additional or alternative steps may be implemented while achieving aspects provided herein. As such, blocks may be added or omitted while still staying within the scope hereof.

Process

The process of using SCF $CO_2$ in a material dying or finishing application relies on manipulation of multiple variables. The variables include time, pressure, temperature, quantity of $CO_2$, and flow rate of the $CO_2$. Further, there are multiple stages in the process in which one or more of the variable may be manipulated to achieve a different result. Three of those stages include the pressurizing stage, perfusing stage, and the depressurizing stage. In an exemplary scenario, $CO_2$ is introduced into a sealed pressure vessel with the temperature and the pressure increasing such that the $CO_2$ is elevated to at least the critical point of 304 K and 73.87 bar. In this traditional process, the second stage of perfusing the material-to-be-finished occurs. A flow rate may be set and maintained and a time is established for the second stage. Finally, at the third stage in a traditional process, the flow rate is stopped, the application of thermal energy ceases, and the pressure is reduced, all substantially simultaneously to transition the $CO_2$ from SCF to gas.

Improvements over a traditional process are able to be realized by adjusting the different variable. In particular, adjusting the sequence and timing of the variable changes during a stage provides better results. For example, a traditional process may cause the material finish (e.g., dyestuff) to coat the inner surfaces of the pressure vessel. The coating of the pressure vessel is inefficient and undesired as it represents material finish that was not perfused through the intended material and requires subsequent cleaning to ensure the material finish is not perfused into a subsequent material for which it is not intended. Stopping the flow rate at the initiation of the third stage causes the $CO_2$ and the material finishes dissolved therein to become stagnate within the pressure vessel. As $CO_2$ transitions from SCF to gas, the material finish in this stagnant environment may not find a suitable host to attach as the material finish comes out of solution with the $CO_2$ at the phase change. Therefore, the pressure vessel itself may become the target of the surface finish as opposed to the target material. Manipulation of the variables may allow for the material finish to favor adhering/bonding/coating the intended target material as opposed to the pressure vessel itself.

In the third stage, it is contemplated that the flow rate is maintained or not ceased until the $CO_2$ changes from the SCF to gas state. For example, if the pressure within the pressure vessel is operating at 100 bar during the perfusing stage, the $CO_2$ may stay in SCF state in the third stage until the pressure is reduced below 73.87 bar. As a result, when the second stage is completed, instead of stopping the flow of $CO_2$ or significantly reducing the flow rate of $CO_2$ within the pressure vessel, the flow rate is maintained through the third stage. In an additional concept, the flow rate of the $CO_2$ is maintained until the pressure reduces below 73.87 bar.

At least two different scenarios for the third stage are contemplated. The first scenario is a sequence where the third stage of the process initiates at the reduction in temperature of the $CO_2$. For example, the second stage may be operating at 320 K, in an exemplary aspect, at the completion of the second stage, the temperature is allowed to decline from the operating temperature of 320 K. While a traditionally process may also stop the flow of $CO_2$ within the pressure as the temperature begins to decline, it is contemplated that instead the flow rate is maintained, at some level, until at least the temperature falls below the critical temperature of $CO_2$, 304 K. In this example, the $CO_2$ may remain in the SCF until the temperature falls below 304 K; therefore, the flow rate is maintained to move the $CO_2$ and dissolved material finishes therein around the target material. In this first scenario, the pressure may be maintained at the operating pressure (or above 73.87 bar) until the $CO_2$ changes from SCF to another state (e.g., liquid if above 73.87 bar). Alternatively, the pressure may also be allowed to drop at the commencement of the third stage, but the flow is maintained until at least the $CO_2$ changes to a different state.

The second scenario, while similar to the first, relies on the third stage being initiated by a decline in pressure. For example, if the operating pressure within the pressure vessel to perfuse the material is 100 bar, the third stage is initiated when the pressure drops. While a traditional process may cease the flow rate of the $CO_2$ at this point, it is contemplated that instead the flow rate is maintained or not ceased simultaneously. Instead, at the third stage, the $CO_2$ is subject to flow until the pressure drops below at least 73.87 bar to ensure circulation of the $CO_2$ having dissolved surface finishes contained therein the entirety of time the $CO_2$ is at a SCF state. The temperature may also be dropped simultaneously with the pressure decline or it may be maintained until a certain pressure is achieved.

In an exemplary aspect, the third stage initiates with the pressure dropping and the temperature dropping toward the $CO_2$ critical point, but the flow rate of the $CO_2$ is maintained, at least in part, until the $CO_2$ has transitioned from the SCF state. While specific temperatures and pressures are listed, it is contemplated that any temperature or pressure may be used. Further, instead of relying on the $CO_2$ achieving a particular temperature or pressure, a time may be used for when to reduce or cease the $CO_2$ flow rate, in an exemplary aspect.

Manipulation of the variable is not limited to the third stage. It is contemplated that a higher equilibrium saturation of surface finish may be achieved by adjusting the variables in the first and second stages. For example, the flow rate may begin before the $CO_2$ transitions from a first state (e.g., gas or liquid) to a SCF state. It is contemplated that as $CO_2$ transitions into a SCF state, the material finish that is to-be-dissolved in the SCF is exposed to a non-stagnate pool of $CO_2$ allowing an for an equilibrium of solution to occur sooner, in an exemplary aspect. Similarly, it is contemplated that the thermal energy is applied to the pressure vessel internal volume before the introduction of $CO_2$ and/or before the pressurization of the $CO_2$ begins. As the transfer of thermal energy may slow the process because of thermal mass of the pressure vessel, it is contemplated that the addition of the thermal energy occurs, in an exemplary aspect prior to the application of pressure.

Absorbent Material Finish Carrier Having a Different Polarity

As provided herein, a sacrificial material may be used as a transport vehicle to introduce the material finish (e.g., dyestuff) intended to be perfused through the target material. In an exemplary aspect, the material finish is soluble in $CO_2$ SCF allowing the SCF to dissolve the material finish to perfuse the material. SCF is non-polar; therefore, the chemistry of material finishes that are operable in a $CO_2$ SCF processing system are chemistries that dissolve in a non-polar solution. For example, dyestuff suitable for dying a polyester material may dissolve in $CO_2$ SCF, but not dissolve in water. Further, the dyestuff suitable for dyeing polyester may not have the appropriate chemistry to bond with a different material, such as an organic material like cotton. Therefore, it is contemplated that an organic material (e.g., cotton) is soaked in the material finish to be applied to a polyester material. The soaked organic material serves as the carrier material into the pressure vessel. When the $CO_2$ SCF process is performed, the material finish is dissolved by the $CO_2$ SCF and perfused through the polyester material. The organic material, which would require a different chemistry for material finish bonding, does not maintain the material finish and therefore the intended amounts of the material finish are available for the perfusing the target material.

In an example, a cotton material is used as a transport vehicle for dye stuff to dye a polyester material. In this example, 150 kg of polyester is desired to be dyed in a $CO_2$ SCF process. If 1% of total target weight represents the amount of dye stuff needed to achieve a desired coloration. Then 1.5 kg of dye stuff is needed to be perfused into the polyester to achieve the desired coloration. The 1.5 kg of dye stuff may be diluted in an aqueous solution with 8.5 kg of water. Therefore, the dye stuff in solution is 10 kg. Because the dye stuff has a chemistry suitable for dissolving in a non-polar $CO_2$ SCF, the dyestuff is merely suspended in the water as opposed to dissolved in the water, in this exemplary aspect. Cotton is highly absorbent. For example, cotton may be able to absorb up to 25 times its weight. Therefore, in order to absorb the 10 kg of dye stuff solution, a 0.4 kg portion of cotton (10/25=0.4) may serve as the carrier. However, it is contemplated that a larger portion of cotton may be used to achieve the transport of the dye stuff solution. In an exemplary aspect, a 30% absorption by weight of the cotton is contemplated. In the example above using 30% by weight absorption, the cotton is 33.3 kg to carry the 10 kg of dye stuff solution. It should be understood that the solution amount, dye stuff amount, and absorption amount may be adjusted to achieve the desired amount of material to be included in the pressure vessel for the dyeing process.

As applied to specific material finishing examples, it is contemplated that a material having different bonding chemistry needs than the target material (e.g., cotton to polyester) is submerged or otherwise soaked with a material finish solution. The soaked carrier material is then placed in the pressure vessel. The soaked carrier may be placed on a support structure or wrapped around the target material. The process of $CO_2$ SCF finishing may be initiated. The $CO_2$ SCF passes around and through the carrier material and dissolves the material finish for perfusing the target material with the material finish. At the completion of the material finish application, the $CO_2$ is transitioned from the SCF state to a gaseous state (in an exemplary aspect). The material finish, which does not have a bonding chemistry for the carrier material, is attracted to and maintained by the target material, in an exemplary aspect. Therefore, at the completion of the finish process, the material finish is applied to the target material and the carrier material is void of appreciable quantities of the material finish, in an exemplary aspect.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A method of applying a material finish, the method comprising:

winding a first material having a material finish around a beam;

subsequent to winding the first material around the beam, winding a target material around an outermost layer of the first material;

positioning the target material and the second material in a common pressure vessel;

introducing carbon dioxide ("$CO_2$") within the pressure vessel;

pressurizing the pressure vessel to at least 73.87 bar, wherein the $CO_2$ achieves a supercritical fluid ("SCF") state while in the pressure vessel;

initiating a flow of the $CO_2$ before or after achieving SCF state;

perfusing, using SCF $CO_2$, the target material with material finish from the first material;

reducing the pressure within the pressure vessel while maintaining the flow of $CO_2$; and reducing the flow of the $CO_2$ after the pressure is below 73.87 bar.

2. The method of claim 1, wherein the material finish has a greater bonding affinity when dissolved in SCF $CO_2$ with the target material than with the first material.

3. The method of claim 1, wherein the target material is a spooled material.

4. The method of claim 1, wherein the target material is a rolled material.

5. The method of claim 4, wherein the first material contacts the target material.

6. The method of claim 1, wherein the material finish includes at least one selected from the following:

a colorant;

a hydrophilic finish;

a hydrophobic finish; and an anti-microbial finish.

7. The method of claim 1, wherein the target material is comprised of a hydrophilic material.

8. The method of claim 1, wherein the target material is comprised of an organic material.

9. The method of claim 1, wherein material finish is homogenized on the first material prior to introducing the $CO_2$.

10. The method of claim 1, wherein initiating a flow of the $CO_2$ before or after achieving SCF state comprises increasing the circulation of $CO_2$ within the pressure vessel to a first flow rate, wherein the first flow rate is maintained until the pressure is below 73.87 bar.

11. The method of claim 10 further comprising simultaneously reducing the temperature in the pressure vessel while reducing the pressure in the pressure vessel.

12. The method of claim 10 further comprising reducing the temperature in the pressure vessel after the pressure is below 73.87 bar.

* * * * *